US005257081A

United States Patent [19]

Kato et al.

[11] Patent Number: 5,257,081

[45] Date of Patent: Oct. 26, 1993

[54] IMAGE FORMING DRIVE HAVING TWO COVER MODES AND A STAPLER FOR STAPLING A GROUP OF CONTENT PAGES AND A COVER PAGE

[75] Inventors: Tomokazu Kato; Yoshihito Hirano, both of Toyokawa, Japan

[73] Assignee: Minolta Camera Kabushiki Kaisha, Osaka, Japan

[21] Appl. No.: 858,499

[22] Filed: Mar. 27, 1992

[30] Foreign Application Priority Data

Apr. 22, 1991 [JP] Japan ..... 3-118000

[51] Int. Cl.[5] ..... G03G 21/00

[52] U.S. Cl. ..... 355/324; 270/32; 270/45; 270/58; 355/309

[58] Field of Search ..... 355/25, 324, 325, 309, 355/311, 321; 270/32, 37, 45, 53, 58

[56] References Cited

U.S. PATENT DOCUMENTS 4,592,651 6/1986 Oikawa et al. ..... 355/72
4,626,156 12/1986 Baughman et al. ..... 270/58 X
4,763,161 8/1988 Forest et al. ..... 355/325 X
4,864,350 9/1989 Ishiguro et al. ..... 355/311
4,924,265 5/1990 Partilla et al. ..... 355/325 X
4,925,176 5/1990 Acquaviva ..... 271/3.1
4,989,852 2/1991 Gunther, Jr. ..... 270/53 X
5,079,598 1/1992 Kaneko et al. ..... 355/309
5,082,255 1/1992 Brigante et al. ..... 270/45

*Primary Examiner*—A. T. Grimley
*Assistant Examiner*—William J. Royer
*Attorney, Agent, or Firm*—Burns, Doane, Swecker & Mathis

[57] ABSTRACT

A copying apparatus having a cover page function, folding function, and binding function. A cover paper twice as large as the content page originals is used for the cover sheet. The cover page copy paper is folded in two and the copy paper for the content page originals is held between the folded cover sheet. The folded cover sheet and the content page copy sheets held between the folded cover sheet are bound by stapling.

13 Claims, 27 Drawing Sheets

LEFT-COVER-OPEN MODE

RIGHT-COVER-OPEN MODE

F: FORWARD

R: REVERSE

F: FORWARD

R: REVERSE

IMAGE FORMING DRIVE HAVING TWO COVER MODES AND A STAPLER FOR STAPLING A GROUP OF CONTENT PAGES AND A COVER PAGE

BACKGROUND OF THE INVENTION

1. Field of the Invention

The present invention relates to an image forming apparatus for forming images on copy paper, and more specifically relates to an image forming apparatus having a folding function for folding the copy paper bearing an image formed thereon and a binding function for binding the copy paper bearing an image formed thereon.

2. Description of the Related Arts

Numerous copying apparatus have been proposed and realized which provide a binding function for binding, using staples, a plurality of copy papers bearing formed images thereon. The final copy product produced by said type of copying apparatus is simply the aforesaid plurality of copy papers bound by staples.

Copying apparatus similarly have been proposed which provide a folding function for folding a copy paper bearing formed images thereon. The final copy product produced by said type of copying apparatus is such that all the plurality of copy papers are uniformly folded.

Copying apparatus also have been proposed which provide the further capability of feeding a cover sheet before and/or after copying. The final copy product produced by said type of copying apparatus has a cover sheet attached to the aforesaid copy papers. Thus, the final copy product produced by this type of copying apparatus simply adds to the content page copy papers a cover sheet of the same size.

SUMMARY OF THE INVENTION

A main object of the present invention is to provide an image forming apparatus with the capability of producing a final copy product having a more refined form than is produced by conventional apparatus.

The aforesaid object of the invention is accomplished by providing copy paper of a first size for the content pages and copy paper of a different size for the cover page.

The aforesaid object of the invention is accomplished by folding the aforesaid cover page into two while holding the copy paper corresponding to the content pages between the folded cover page.

The aforesaid object of the invention is accomplished by combining the binding function and the folding function to bind the aforesaid folded sheet.

DESCRIPTION OF THE PREFERRED EMBODIMENTS

The preferred embodiments of the present invention are described hereinafter.

1) Copying Apparatus Construction

The construction of the copying apparatus is described below with reference to FIGS. 1 through 4.

The copying apparatus comprises a circulating document handler (RDH) 10 provided on top of the document platen 30 of the copying apparatus 20, and a finisher 40 mounted on the paper discharge side of the copying apparatus 20.

Figure 1:
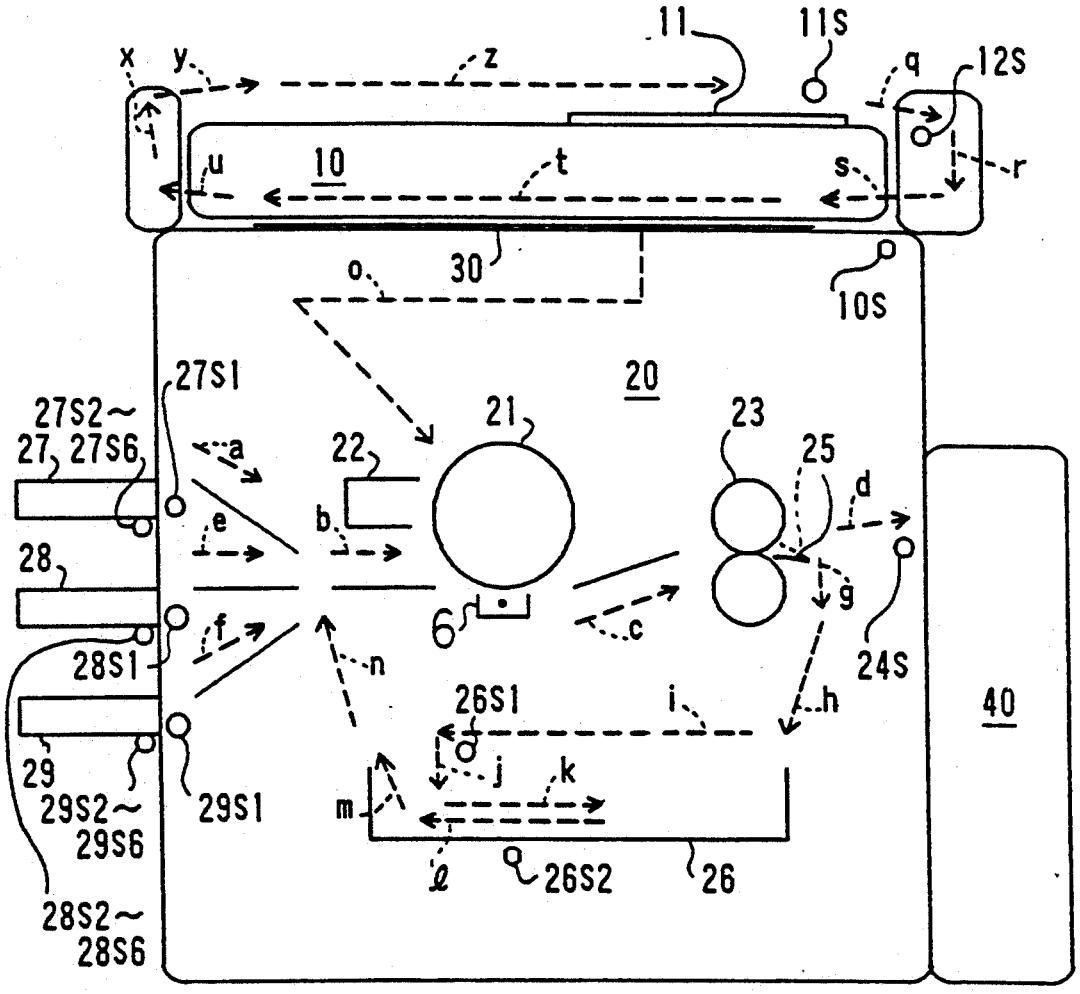
FIG. 1 is an illustration showing the construction of an embodiment of the copying apparatus of the present invention.

(a) RDH 10 (FIG. 1)

The RDH 10 is a device which automatically feeds and counts said fed original documents. That is, the original documents are placed face-up on the document tray 11, and sequentially fed from the lowermost original in accordance with control signals transmitted from the central processing unit (CPU) 61 of the main apparatus (FIG. 4) onto the glass document platen 30 of the main unit of the copying apparatus 20 via the feed path q→r→s indicated by the dashed arrows, so as to be set at a predetermined scanning position. When the original document is in the aforesaid scanning position, the image of the original document is scanned via an optical system, the original is then discharged via the path t→u→x→y indicated by the dashed arrows, and returned to the aforesaid document tray 11 via the path z indicated by the dashed arrow. The RDH 10 is capable of original document feed-type image scanning (panning).

The originals set on the document tray 11 are detected by original sensor 11S. After an original detection signal OS1 is output from the original sensor 11S and input to the CPU 45 of the RDH 10, said signal is transmitted to the main unit CPU 61 (refer to FIG. 4). The originals fed from the document tray 11 for image scanning are detected by the original sensor 12S. After and original detection signal OS2 is output from the original sensor 12S and input to the CPU 45 of the RDH 10, said signal is transmitted to the main CPU 61. The number of fed original documents is calculated by counting the number of times the original detection signal OS2 is generated. Furthermore, the connection of the RDH 10 to the main unit 20 of the copying apparatus can be detected by the RDH sensor 10S provided on the main unit 20. The RDH sensor 10S detects the installed RDH 10 and outputs an RDH detection signal RS which is transmitted to the main unit CPU 61.

(b) Copying Apparatus Main Unit 20 (FIG. 1)

The copying apparatus main unit 20 performs an electrophotographic type copying process. That is, an original document placed at a predetermined scanning position on the glass platen 30 is exposed by a scanning optical system not shown in the drawing, the optical image reflected form the original is guided along the optical path indicated by the dashed arrow o onto the uniformly charged surface of the photosensitive drum 21 which is rotating at constant speed, so as to form an electrostatic latent image on the surface of said photosensitive drum 21, the latent image is then developed into a toner image by means of the developing device 22, the toner image is then transferred onto a copy paper which is fed thereto with a predetermined timing, and said toner image is then fused onto the copy paper by a fixing device.

When the upper paper cassette 27 is selected, the copy paper is fed from the upper cassette 27 to the transfer portion through the feed path indicated by the dashed arrow a→b (the transfer position being between the photosensitive drum 21 and the transfer charger 6), whereupon the transfer process is executed. When the middle cassette 28 is selected, the copy paper is fed from the middle cassette 28 to the transfer portion through the feed path indicated by the dashed arrow e→b, and when the lower cassette 29 is selected, the copy paper is fed from the lower cassette 29 to the transfer portion through the feed path indicated by the dashed arrow f→b.

The paper cassettes 27, 28 and 29 are respectively provided with sensors 27S1, 28S1 and 29S1 for detecting presence of copy paper within said cassettes, and sensors 27S2 through 27S6, 28S2 through 28S6, and 29S2 through 29S6 for detecting the size and type of said copy paper accommodated in each cassette. The detection signals of the aforesaid sensors are transmitted to the main CPU 61 (refer to FIG. 4). Codes are generated which correspond to the size and type of copy paper accommodated in each of the aforesaid cassettes via the aforesaid signals output by the sensors 27S2 through 27S6, 28S2 through 28S6, and 29S2 through 29S6.

The copy paper which has been subjected to the previously described transfer process is then transported to the fixing device 23 through the feed path indicated by the dashed arrow c where the fixing process is accomplished. Thereafter, the copy sheet is transported to the finisher 40 or the duplex copy intermediate tray 26 in accordance with the set position of the selector 25.

That is, when the selector 25 is set at the solid line position (discharge position), the copy paper is guided on the top surface of said selector 25 through the feed path indicated by the dashed arrow d so as to be advanced to the finisher 40 outside the main unit. The copy sheet fed from the fixing device 23 to the finisher 40 is detected by the discharge sensor 24S. The processing accomplished in the finisher 40 is described later.

When the selector 25 is set at the dashed line position (refeed position), the copy paper is guided on the bottom surface of said selector 25 through the feed path indicated by the dashed arrows g→h→i→j→k so as to be accommodated in the intermediate tray 26 with the image bearing surface face-up.

The intermediate tray 26 temporarily accommodates the copy sheet bearing an image formed on a first side (front side) in preparation for accomplishing the copying process on the second side (back side) thereof when the duplex copy mode is selected.

That is, when copying on the second side of the copy paper in the duplex mode, the copy paper accommodated in the intermediate tray 26 is fed to the transfer portion through the feed path indicated by the dashed arrows l→m→n→b, and the copying process is accomplished on said second side of the copy sheet. The sensor 26S1 is provided to detect the copy paper fed to the intermediate tray 26, and the sensor 26S2 is provided to detect the presence of a copy sheet within the intermediate tray 26.

Figure 2:
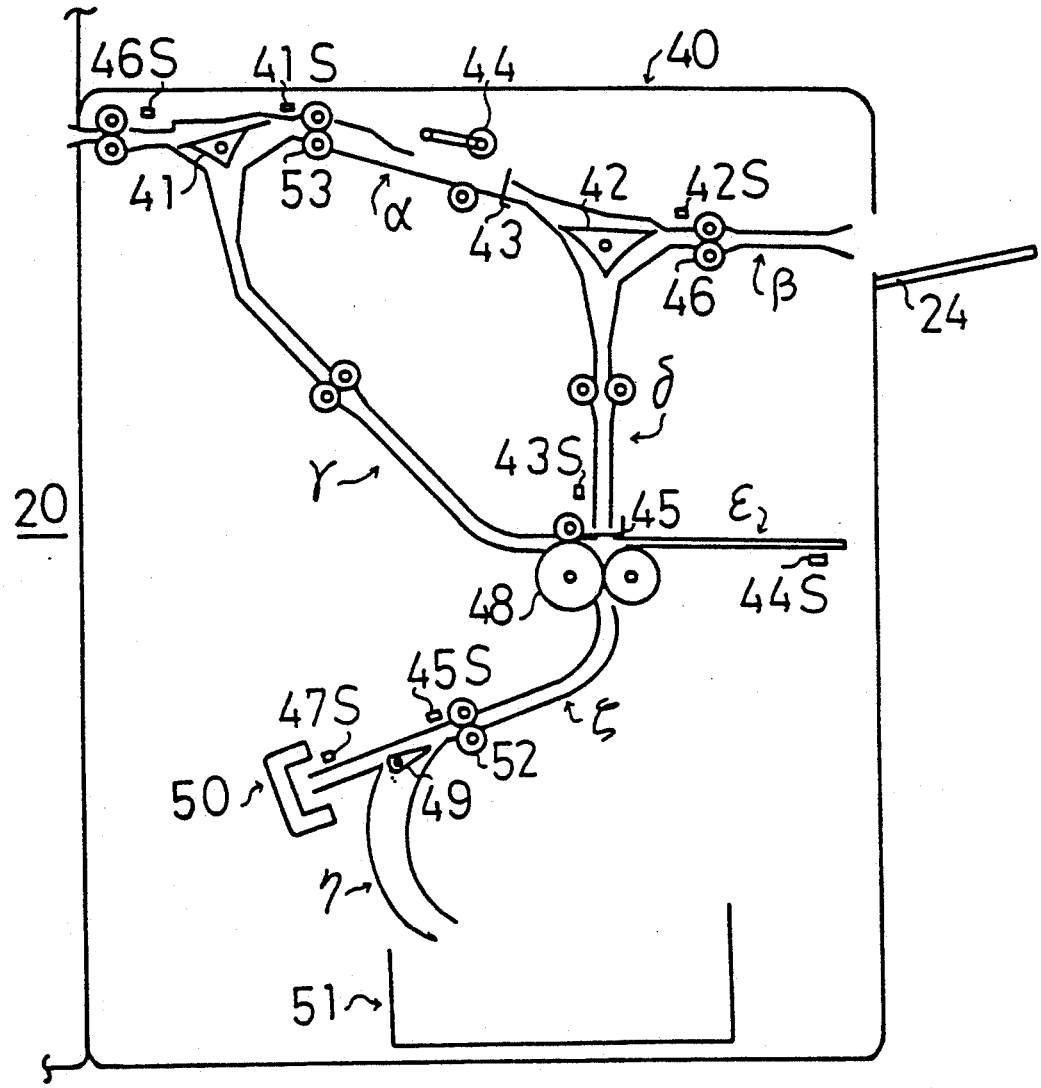
FIG. 2 is an illustration showing the construction of the finisher of the aforesaid copying apparatus.

(c) Finisher 40 (FIG. 2)

The finisher 40 staples the copy papers fed from the copying apparatus main unit 20 so as to bind them together, then accommodates said stapled papers within the tray 51. The finisher 40 is provided with feed paths $\alpha$, $\beta$, $\gamma$, $\delta$, $\epsilon$, $\zeta$, $\eta$, as shown in FIG. 2. The aforesaid feed paths are selectably used in accordance with the selected mode. The aforesaid feed path selection is changed by switching the set position of the selectors 41, 42 and 49, switching ON/OFF the rollers 44, 46, 48, 52 and 53, and switching ON/OFF the stoppers 43 and 45.

For example, when the non-staple mode (discharge mode) is selected, the feed paths $\alpha$ and $\beta$ are selected to feed the copy paper through the path $\alpha \rightarrow \beta$, and discharge the copy sheet to the external discharge tray 24.

When the stapling mode is set, the feed paths $\alpha$, $\delta$ and $\zeta$ are sequentially selected, and the copy sheets of a single bundle are transported to the stopper 50. Following the stapling process, the selector 49 is switched to select the feed path $\eta$ so that said copy sheet are discharged to the tray 51.

Figure 25A:
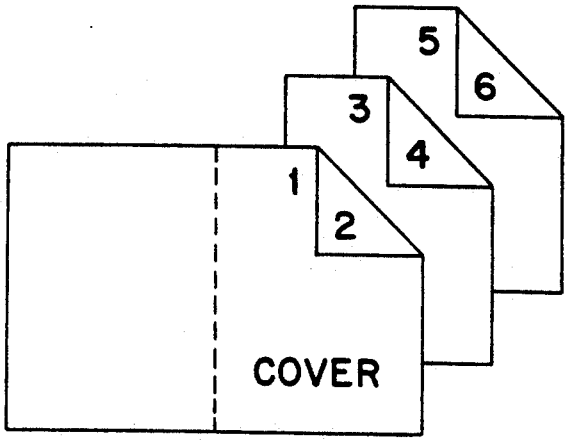
FIGS. 25(*a*) and 25(*b*) are illustrations showing the left-cover-open mode and the right-cover-open mode.
Figure 25B:
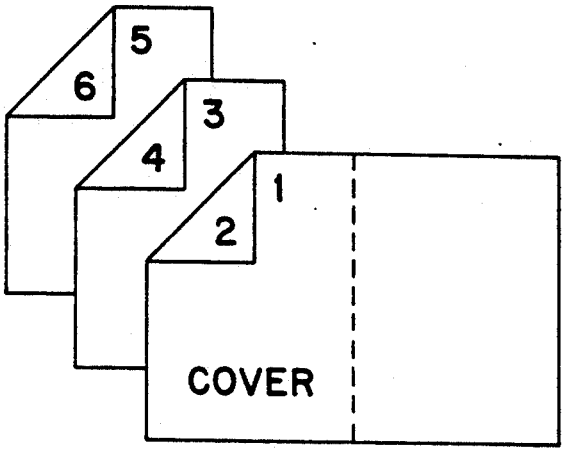

In the right-cover-open mode (ROC), the feed paths $\alpha$ and $\delta$ are selected for the copy sheets corresponding to the content pages of a single bundle of copy papers which are transported to the stopper 45, and the feed paths $\alpha$, $\gamma$ and $\epsilon$ are selected for the copy sheet corresponding to the cover page (the last copy sheet fed from the copying apparatus 20) which is reversed, front end to trailing end, and transported to a position at which the center of said cover sheet is positioned directly below the stopper 45. Thereafter, the stopper 45 is switched OFF, so that the content pages are held between the cover page folded in the center, and the bundle is transported to the stapler 50 via the feed path $\zeta$. Following the stapling process, the selector 49 is switched so as to select the feed path $\eta$, and the copy papers are accommodated in the tray 51 In the right-cover-open mode ROC, the cover sheet is twice as large as the content sheets and opens from the right with the content sheets held therebetween, as shown in FIG. 25*b*.

In the left-cover-open mode (LOC), the feed paths $\alpha$, $\delta$ and $\delta$ are selected for the copy sheets corresponding to the content pages of a single bundle of copy papers which reversed, front end to trailing end, and transported to the stopper 45, and the feed paths $\alpha$, $\gamma$ and $\epsilon$ are selected for the copy sheet corresponding to the cover page (the last copy sheet fed from the copying apparatus 20) which is reversed, front end to trailing end, and transported to a position at which the center of said cover sheet is positioned directly below the stopper 45. Thereafter, the stopper 45 is switched OFF, so that the content pages are held between the cover page folded in the center, and the bundle is transported to the stapler 50 via the feed path $\zeta$. Following the stapling process, the selector 49 is switched so as to select the feed path $\eta$, and the copy papers are accommodated in the tray 51. In the left-cover-open mode LOC, the cover sheet is twice as large as the content sheets and opens from the left with the content sheets held therebetween, as shown in FIG. 25*a*.

To realize the aforementioned functions, the finisher 40 is provided with sensor 46S for detecting the paper fed from the copying apparatus 20, sensor 41S for detecting paper near the entrance to the feed path $\alpha$, sensor 42S for detecting paper near the entrance to the feed path $\beta$, sensor 43S for detecting paper near the entrance of the feed path $\delta$, sensor 44S for detecting paper near the entrance of the feed path $\epsilon$, sensor 45S for detecting paper near the exit (near the front edge of the selector 49) of the feed path $\zeta$, sensor 47S for detecting paper immediately in front of the stapler 50. The detection signals output by the aforesaid sensors are transmitted through the finisher control CPU to the main CPU 61 used to control the copying apparatus (refer to FIG. 4).

When the number of copies is specified, each original document is copied to a single copy sheet. When one set of copies of said originals has been completed (first job cycle), processing is controlled so as to refeed the originals one by one to be sequentially copied a second time (second job cycle).

Figure 3:
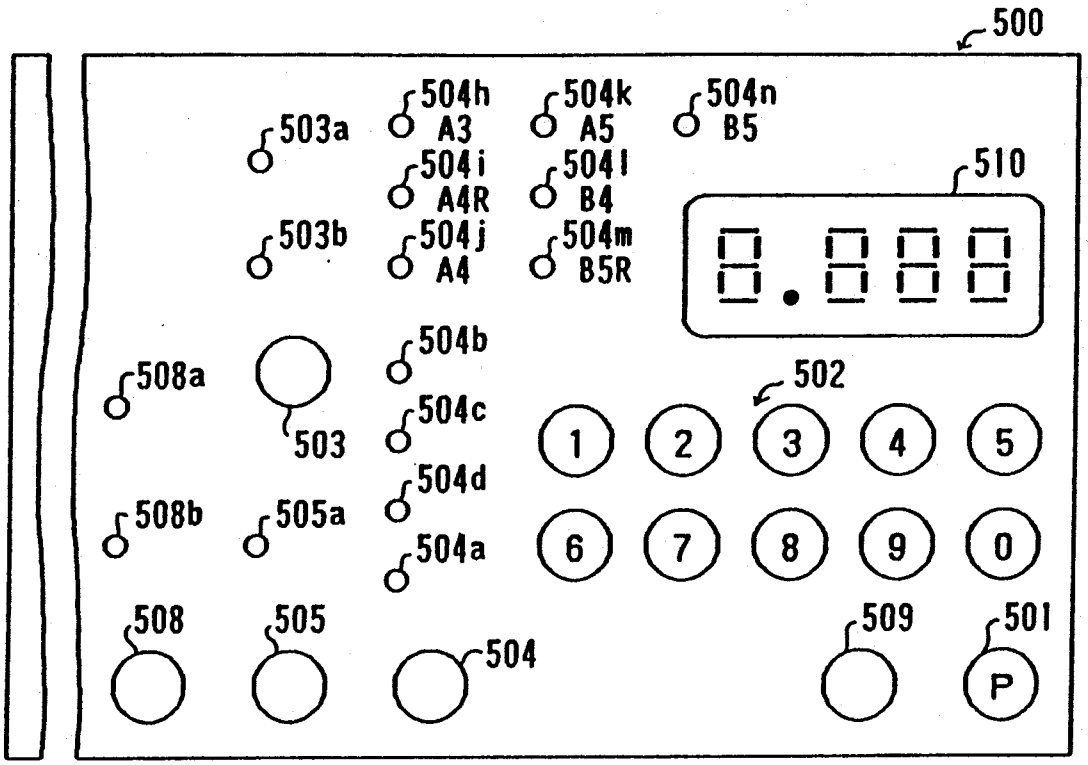
FIG. 3 is an illustration of a portion of the operation panel of the aforesaid copying apparatus.

(d) Operation Panel (FIG. 3)

The operation panel 500 is provided at the front side of the document platen 30 of the copying apparatus 20. Arranged on the operation panel 500 are various kinds of key switches, numeric display portion 510, and light-emitting diode (LED) display elements. The operation input signals generated by each kind of key switch are transmitted to the main CPU 61. The display of the numeric display portion 510 and the flashing of the various LED elements are controlled by signals output from the main CPU 61.

The provided key switches are, for example, print key 501 for issuing the command for starting the copying operation, ten-key pad 502 for numerical input, cover mode key 503, cassette selection key 504, staple mode key 505, copy mode key 508, and copy number recording key 509 for storing in a predetermined area of the random access memory (RAM) 62 the numerical value displayed by the numeric display portion 510 as data describing the number of originals.

The LED elements include display element 503*a* which is lighted when the left-cover-open mode (LOC) is set, display element 503*b* which is lighted when the right-cover-open mode (ROC) is set, display element 504*a* which is lighted to indicate the cassette automatic selection mode is set, display element 504*b* which is lighted to indicate the upper cassette is selected, display element 504*c* which is lighted to indicate the middle cassette is selected, display element 504*d* which is lighted to indicate the lower cassette is selected, display elements 504*h* through 504*n* which are lighted to indicate the size of the copy paper accommodated in the selected cassette, display element 505*a* which is lighted to indicate the staple mode is set, display element 508*a* which is lighted to indicate the single-side copy mode is set, and display element 508*b* which is lighted to indicate the duplex copy mode is set, and the like.

Each time the cover sheet mode key 503 is depressed, the cover sheet modes are displayed in the following rotation →left-cover-open, →right-cover-open, →cover mode cancel, →left-cover-open→, and the corresponding display elements 503*a* and 503*b* are lighted and extinguished in said rotation. The paper cassettes are likewise selected in rotation each time the cassette selection key 504 is depressed, and the corresponding display elements are similarly lighted and extinguished. The staple mode is set or cancelled each time the staple mode key 505 is depressed, and the display element 505*a* is correspondingly lighted and extinguished. The single-side copy and duplex copy modes are alternatingly set each time the copy mode key 508 is depressed, and the corresponding display elements 508*a* and 508*b* are lighted and extinguished.

Figure 4:
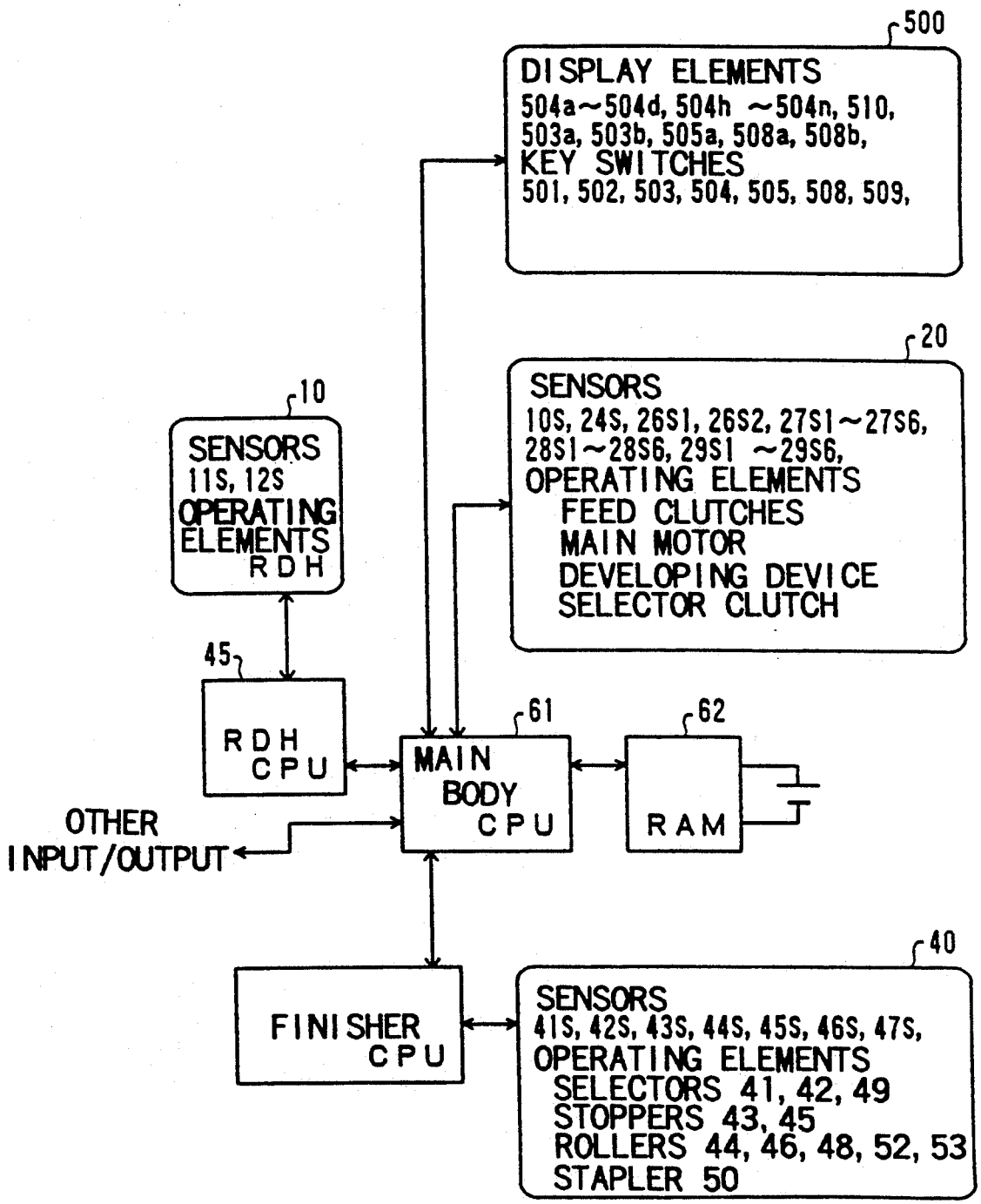
FIG. 4 is a block diagram showing the construction of the control circuit of the aforesaid copying apparatus.

The various aforesaid mode set conditions are stored in the RAM 62 which has battery backup operation. In addition to the aforementioned display elements, the main CPU 61 controls the various operating elements in the copying apparatus 20, e.g., selector 25 clutches and the like, and controls the various operating elements in the finisher 40 via the finisher 40 control CPU, as shown in FIG. 4.

2) CPU 61 Processing

The operation of the copying apparatus is described below through the processing of the CPU 61 with reference to the flow charts in FIGS. 5 through 23. In the following description, "ON-Edge" shall be defined as the change of state when the signal state changes from OFF to ON, and "OFF-Edge" shall be defined as the change of state when the signal state changes from ON to OFF.

Figure 5:
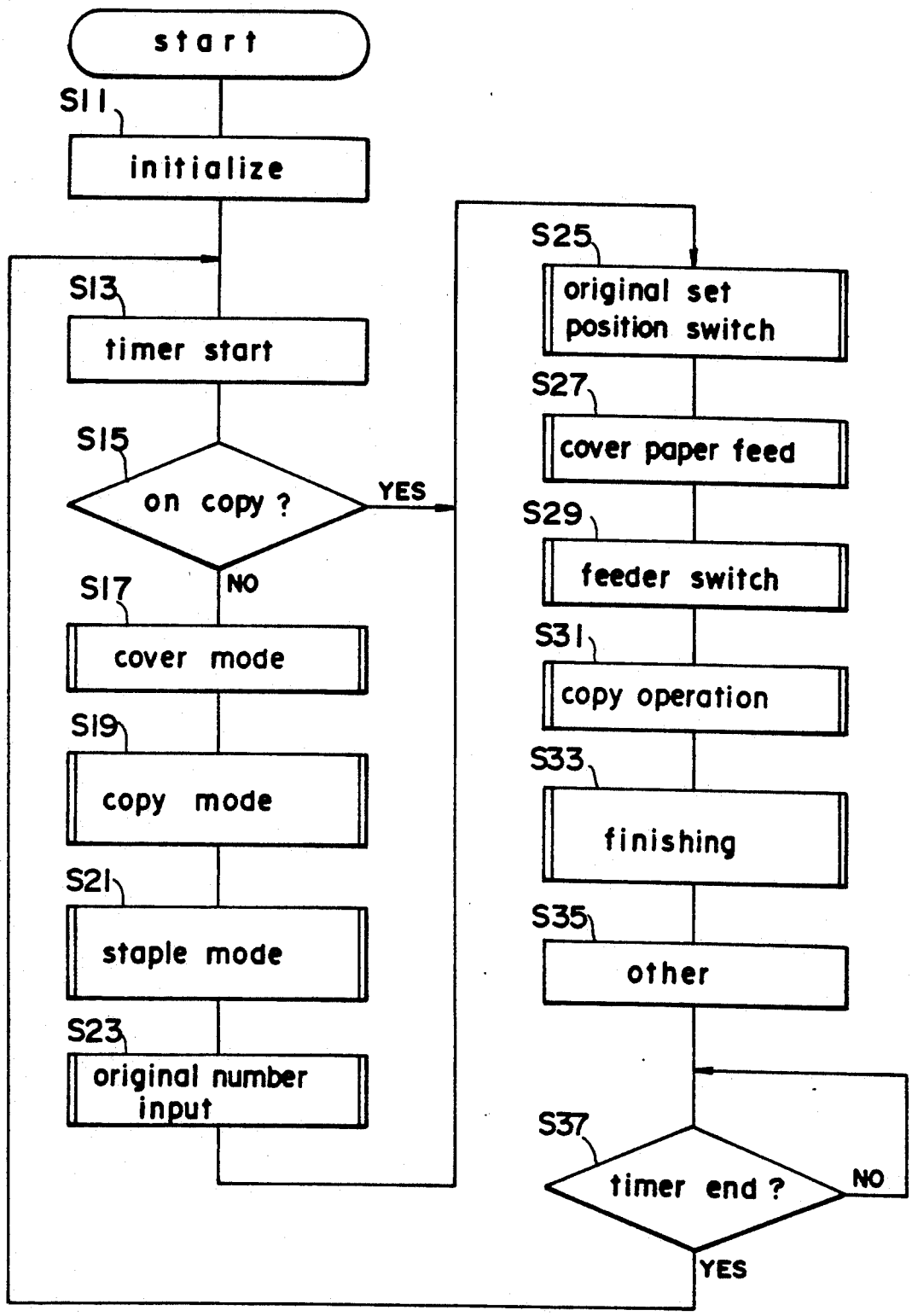
FIG. 5 is a flow chart showing the main routine of processing performed by the control CPU of the aforesaid copying apparatus.

(a) Main Routine (FIG. 5)

The main CPU 61 executes the initialization settings (step S11), e.g., starts processes via a connection to the power source, clears the RAM 62 and the like. Thereafter, a loop process is executed wherein the steps S13 through S37 are repeated An internal timer is started to manage the time period during which a single routine is executed (step S13).

Cover mode key process (S17) is executed under condition that a copy process is not currently on-going (NO in step S15). The cover mode is switched each time the cover mode key 503 is depressed. Details of the process are described later.

Copy mode key process (S19) is executed under condition that a copy process is not currently on-going (NO in step S15). The copy mode is switched each time the copy mode key 508 is depressed. Details of the process are described later.

Staple mode key Process (S21) is executed under condition that a copy process is not currently on-going (NO in step S15). The copy mode is set or cancelled each time the staple mode key 505 is depressed. Details of the process are described later.

Original document number input process (S23) is executed under condition that a copy process is not currently on-going (NO in step S15). The numerical value entered via the operation panel 500 and displayed on the numeric display 510 is recorded as the number of original documents. Details of the process are described later.

Figure 24:
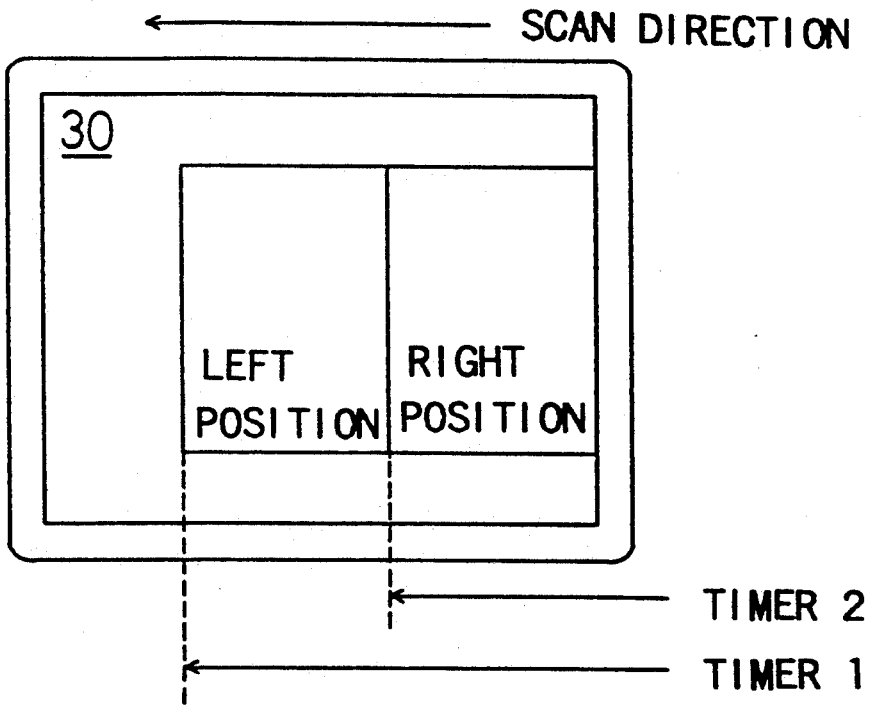
FIG. 24 is an illustration showing the original document set positions.

Original document set position switch process (S25) switches the stopping position of the original fed to the document platen 30 by the RDH 10 to the right side position (document scale side; standard position) or the left side position (refer to FIG. 24). Details of the process are described later.

Cover paper feed process (S27) feeds from the cassette a copy sheet twice as large as the normal copy paper (non-cover copy paper) when either cover paper mode is set. Details of the process are described later.

Feeder switch process (S29) switches the paper discharge position after the copying process, and switches the feeder origin. Details of the process are described later.

Copy operation process (S31) executes the various controls required during the copying operation. Details of this process are described later.

Finishing process (S33) controls the paper stapling and the like after the copy process is completed. Details of this process are described later.

Other processes (S35) are processes other than the aforementioned. This step of the routine executes the other processes in a batch via the CPU 61.

Each of the aforementioned processes are executed, and the end of the internal timer is awaited (S37). When said internal timer ends, the program routine returns to step S13 and the various aforesaid processes are repeated.

Each of the various subroutines is described hereinafter.

Figure 6:
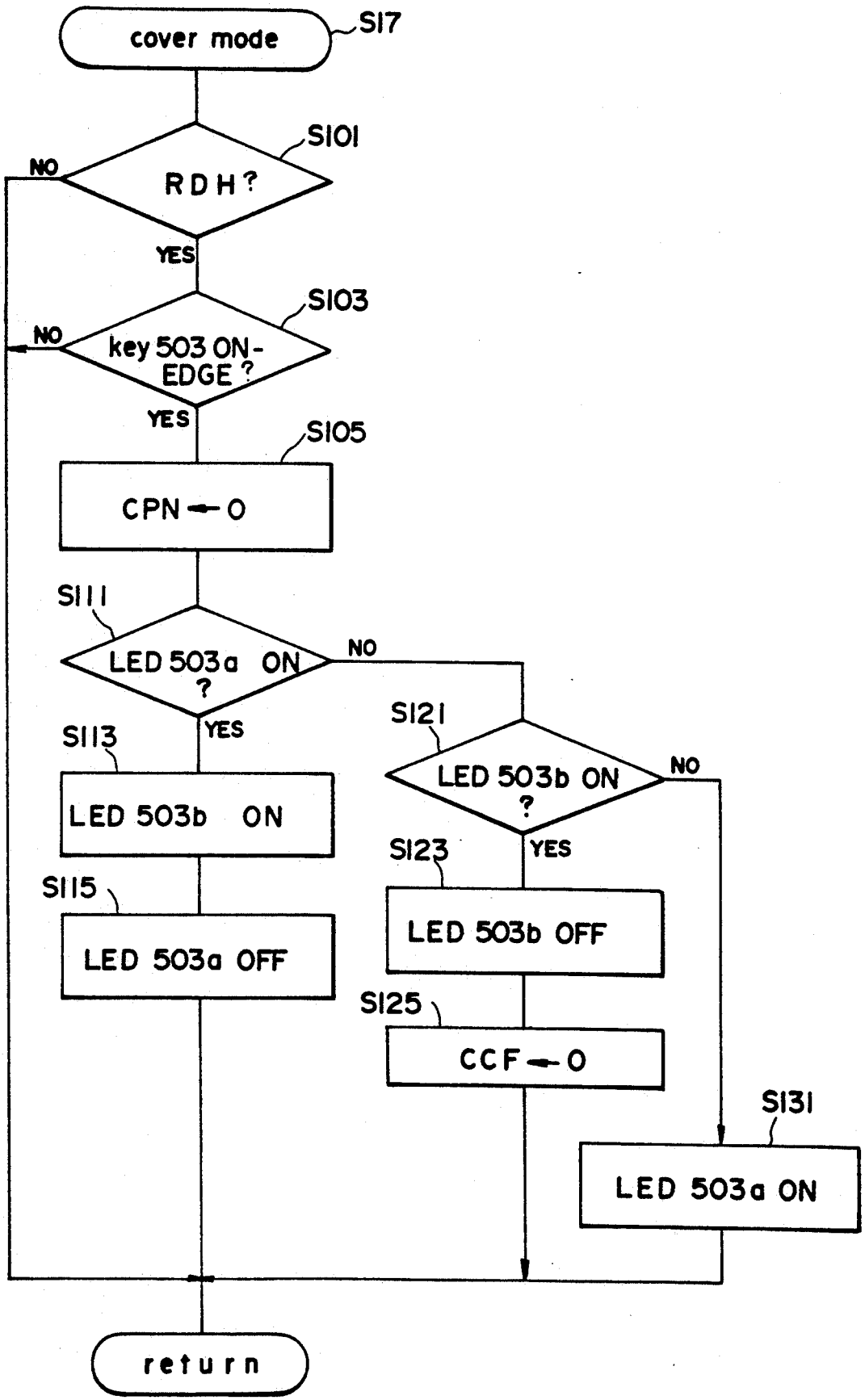
FIG. 6 is a flow chart showing the cover paper mode process routine executed in the aforesaid main routine.

(b) Cover mode key process (FIG. 6)

The cover mode key process (S17) is executed when the RDH 10 is installed on the main unit 20 of the copying apparatus (reply to query in step S101 is YES), and the cover mode key 503 has been depressed, i.e., the ON-Edge state of said key 503 has been detected (reply to query in step S103 is YES).

First, the cover paper NO flag CPN is reset at [0] (step S105). The cover paper NO flag CPN indicates the presence or absence of cover paper (cover paper is twice as large as the content page copy paper and is the last sheet fed).

Then, the cover mode is switched in the rotation of ··→left-cover-open mode LOC, →right-cover-open mode ROC, →cover mode cancel, ··→left-cover-open mode LOC·· (steps S111 through S131).

When, for example, the cover mode key 503 is depressed while the left-cover-open mode LOC is set and the LED 503*a* is lighted (step S111, YES), the right-cover-open mode ROC is set and the LED 503*b* is lighted (step S113), and the left-cover-open mode LOC is cancelled and the LED 503*a* is extinguished (step S115).

When the cover mode key 503 is depressed while the right-cover-open mode ROC is set and the LED 503*b* is lighted (step S121, YES), the right-cover-open mode ROC is cancelled and the LED 503*b* extinguished (step S123), and the cover copy flag CCF is reset at [0] (step S125).

When the cover mode key 503 is depressed while neither the left-cover-open mode LOC or the right-cover-open mode ROC is set (step S121, NO), the left-cover-open mode LOC is set and the LED 503*a* is lighted (step S131).

Figure 7:
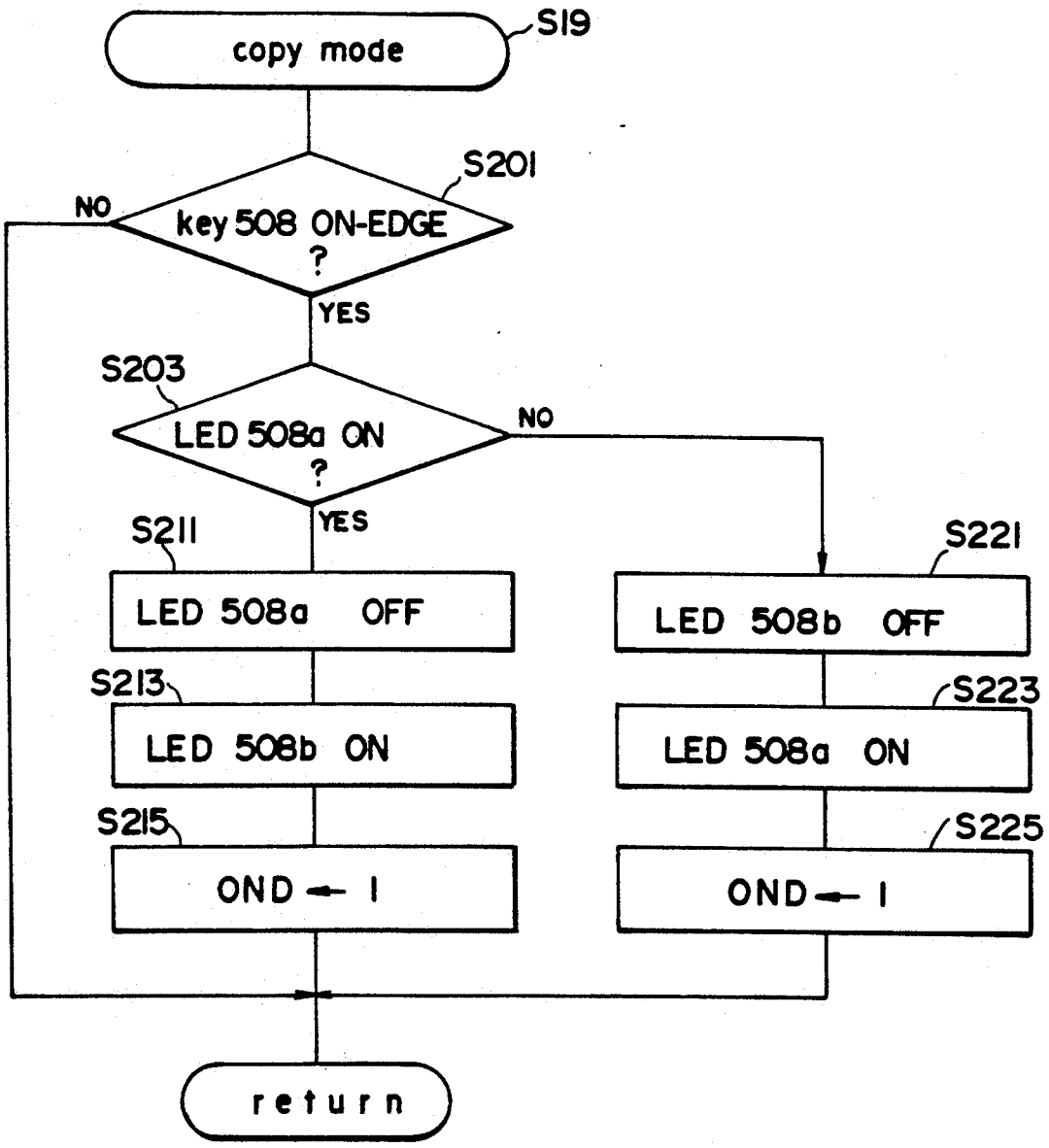
FIG. 7 is a flow chart showing the copy mode process routine executed in the main routine.

(c) Copy Mode Key Process (FIG. 7)

The copy mode key process (step S19) is executed each time the copy mode key 508 is depressed (step S201, YES). The copy mode is switched through the rotation of ··→single-side original/single side copy, →single-side original/duplex copy, →single-side original/single-side copy→··.

That is, when the copy mode key 508 is depressed (step S201, YES) while the single-side original/single-side copy mode is set and the single-side display element 508*a* is lighted (step S203, YES), the single-side original/single-side copy mode is cancelled, the single-side display element 508*a* is extinguished (step S211), and the single-side original/duplex copy mode is set and the duplex display element 508*b* is lighted (step S213). Further, the original number demand flag OND is set at 1 (step S215).

On the other hand, when the copy mode key 508 is depressed while the single-side original/duplex copy mode is set (step S203, NO), the single-side original/duplex copy mode is cancelled, the duplex display element 508*b* is extinguished (step S221), and then the single-side original/single-side copy mode is set and the single-side display element 508*a* is lighted (step S223). Further, the original number demand flag OND is set at [1] (step S225).

Figure 8:
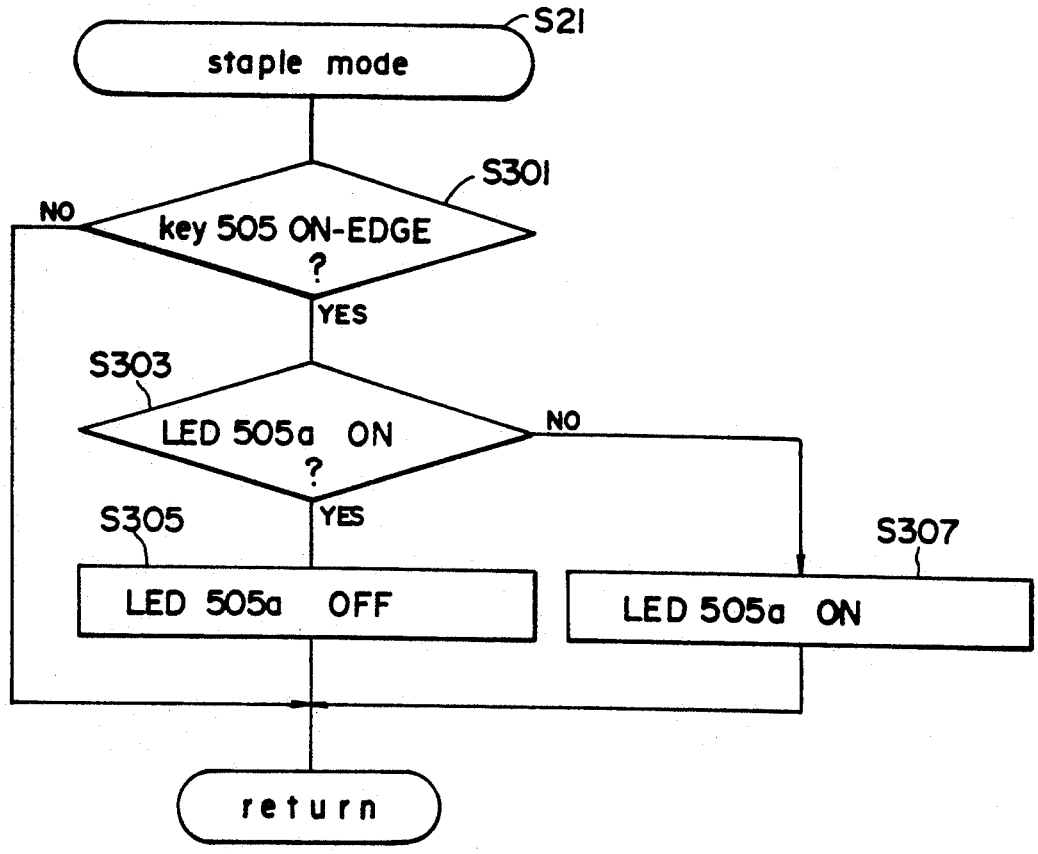
FIG. 8 is a flow chart showing the staple mode process routine executed in the main routine.

(d) Staple Mode Key Process (FIG. 8)

When the staple mode key 505 is depressed and the ON-Edge state is detected (step S301, YES) while the staple display element 505*a* is lighted (step S303, YES) indicating the staple mode is set, the staple mode is cancelled and the staple display element 505*a* is extinguished (step S305).

On the other hand, when the ON-Edge state of the staple mode key 505 is detected (step S301, YES) while the staple display element 505*a* is extinguished indicating the staple mode is cancelled (step S303, NO), the staple mode is then set and the staple display element 505*a* is lighted (step S307).

Figure 9:
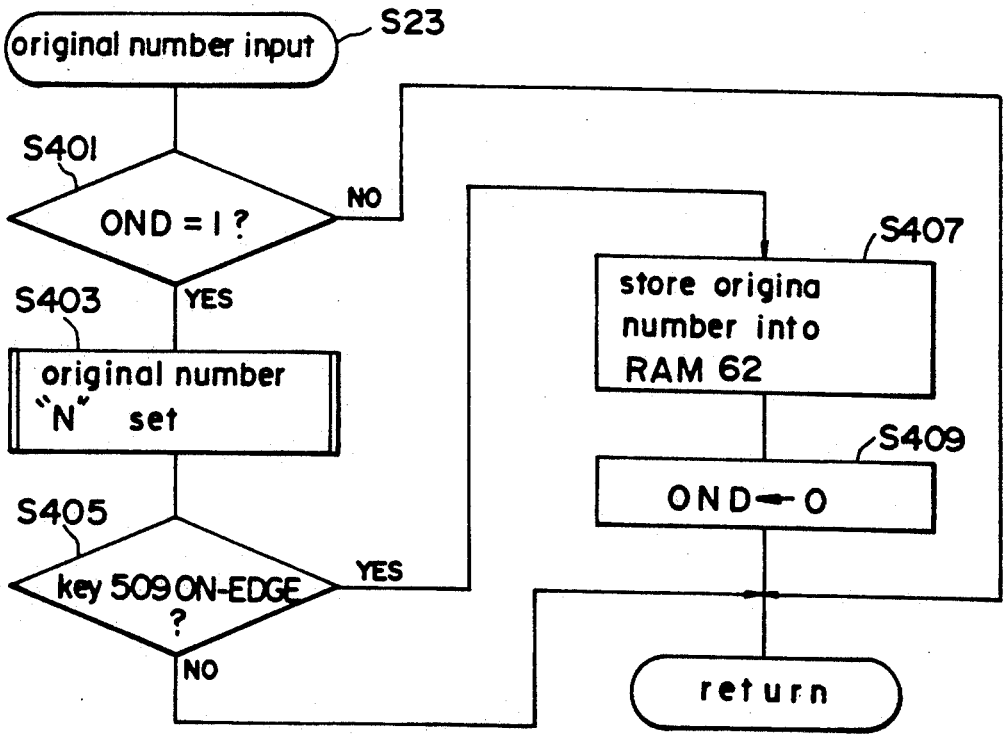
FIG. 9 is a flow chart showing the original document number input process routine executed in the main routine.

(e) Original Document Number Input Process (FIG. 9)

The original document number input process (step S23) is executed when the original number demand flag OND is set at [1] (step S401, YES).

First, the number setting process is executed in step S403. This process sets the numerical value "N" entered via the ten-key pad 502 as the original number data, and displays said numerical value in the numeric display 510.

Then, when the copy number recording key 509 is depressed and its ON-Edge state is detected (step S405, YES), the numerical value displayed in the numeric display 510 is stored in the original document number area of the RAM 62 (step S407). Thereafter, the original number demand flag OND is reset at [0] (step S409), i.e., the original number data input standby state is cancelled.

Figure 10:
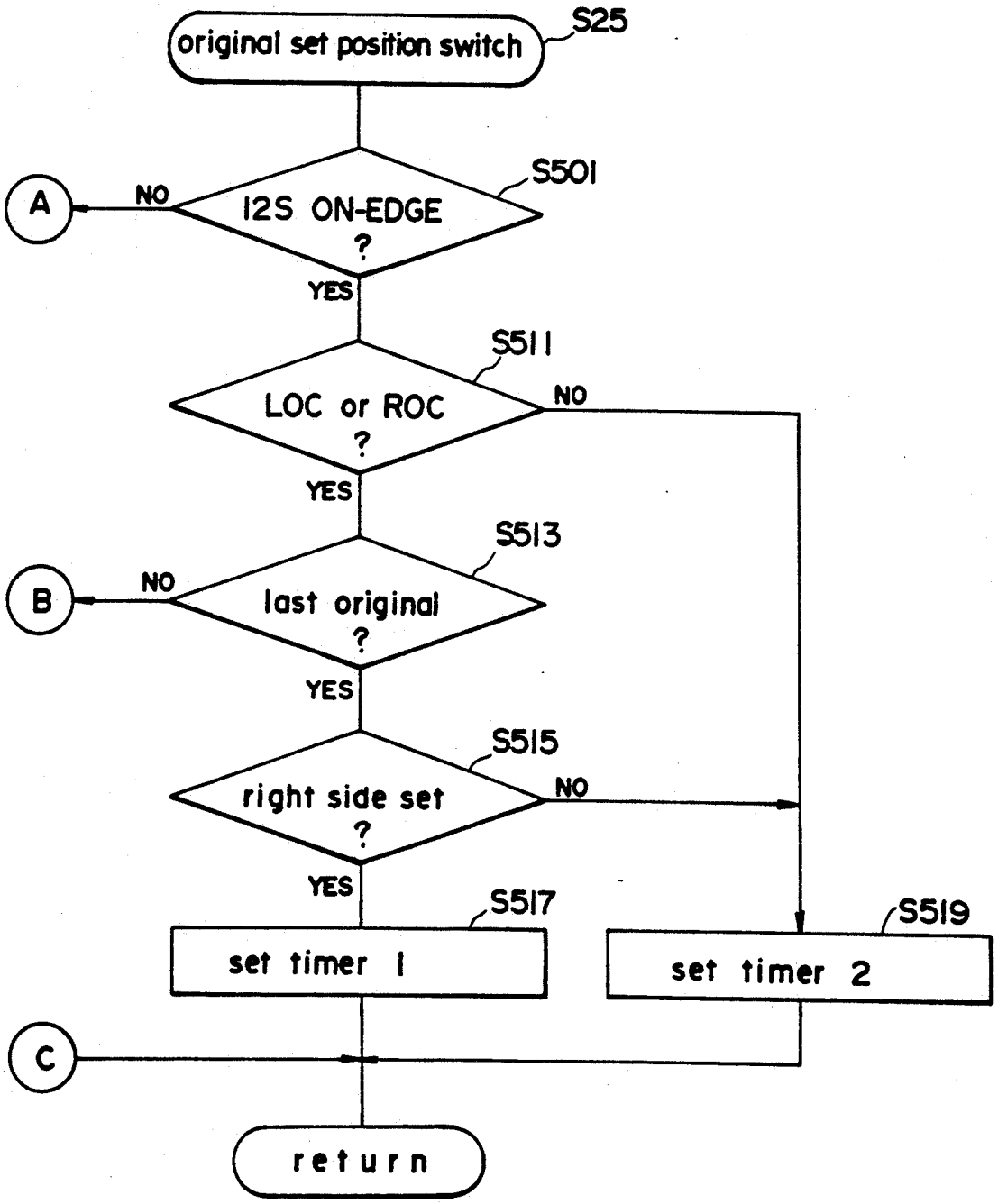
FIG. 10 is a flow chart showing a portion of the original document set position switch process routine executed in the main routine.
Figure 11:
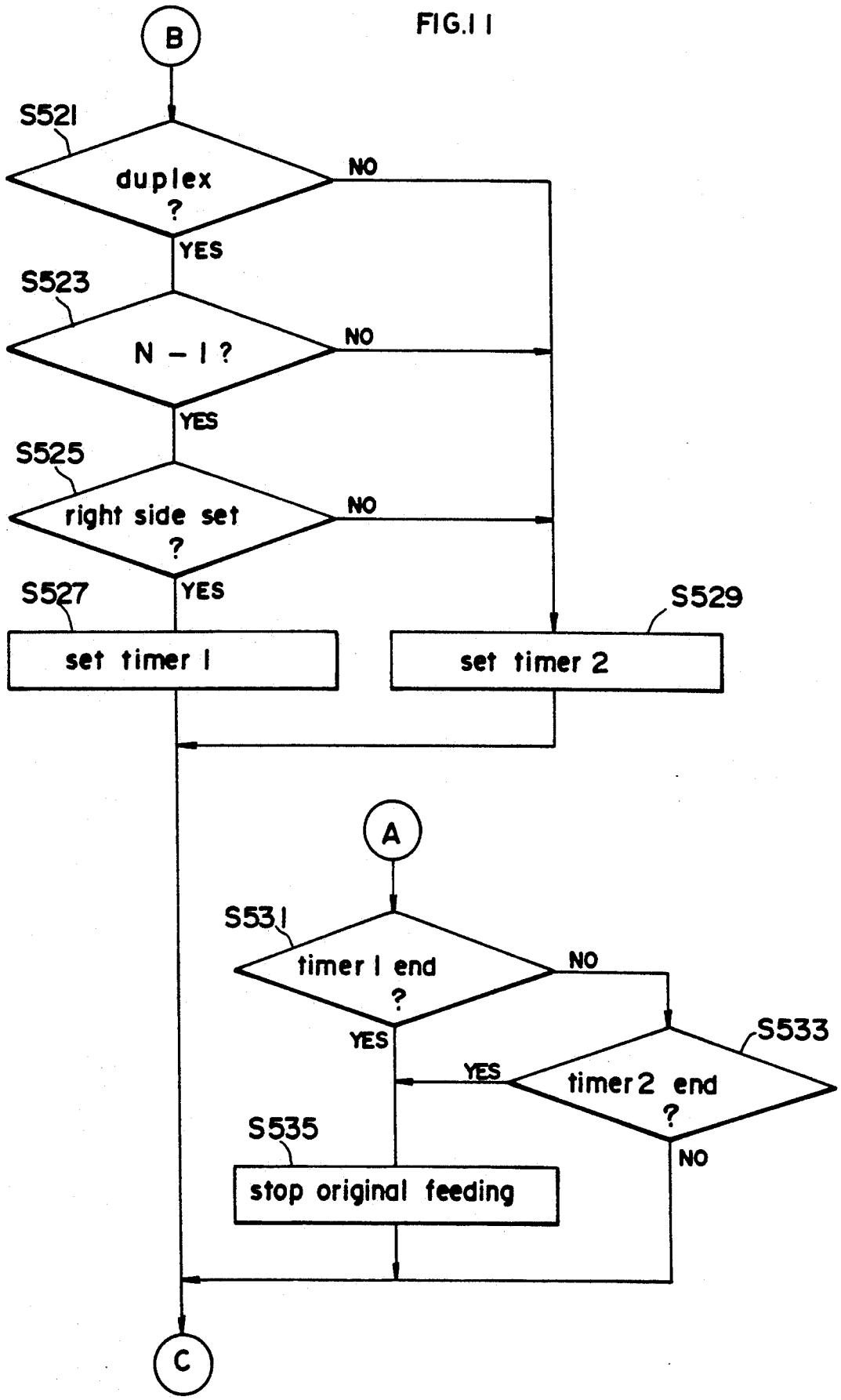
FIG. 11 is a flow chart showing the remaining portion of the original document set position switch process routine executed in the main routine.

(f) Original Document Set Position Switching Process (FIGS. 10 and 11)

In the original set position switching process (step S25), the timers 1 and 2 are selectively started to manage the period for continuous feeding of the originals from the document tray 11. The original document feeding is terminated when either of the aforesaid timers ends.

That is, when the leading edge of the original reaches the position of the original sensor 12S and the ON-Edge state of said original sensor 12S is detected (step S501, YES), one of the timers 1 and 2 is started (steps S517, S519, S527, S529). When the timer ends (step S531, YES or step S533, YES), the feeding of the originals is terminated (step S535).

The timer 1 sets the period required for the leading edge of the original to be transported to the left set position shown in FIG. 24 after said leading edge of the original passes the position of the original sensor 12S. The timer 2 sets the period required for the leading edge of the original to be transported to the right set position, i.e., the standard position at which the trailing edge of the original is aligned with the document scale.

The timer 1 and timer 2 are respectively selected depending on whether or not a cover mode is set (step S511), and when a cover mode is set (step S511, YES), depending on whether or not a copy image is to be formed on the last copy sheet (a cover paper sheet twice as large as the noncover sheets) (steps S513, S521, S523), and when a copy image is to be formed on the last copy sheet (step S513, YES; step S521, YES; step S523, YES), to align the copy image formation position of the cover sheet with the other noncover paper position after stapling (steps S515, S525).

For example, when a cover mode has not been set (step S511, NO), the timer 2 is selected and started (step S519) so as to stop all the originals fed from the RDH 10 at the aforementioned standard position (right set position).

When a cover mode is set (step S511, YES) but a copy image is not to be formed on the cover paper (step S513, NO and step S521, NO, or step S513, NO and step S521, YES, and step S523, NO), the timer 2 is similarly selected and started (step S529) so as to stop the originals fed from the RDH 10 at the aforementioned standard position (right set position).

On the other hand, when a cover mode is set (step S511, YES) and a copy image is to be formed on the cover paper (step S513, YES, or step S513, NO and step S521, YES, and step S523, YES), a timer is selected and started to align the copy image formation position of the cover sheet with the other noncover paper position after stapling, as shown in FIG. 25 (steps S515, S517, S519, S525, S527, S529).

Figure 12:
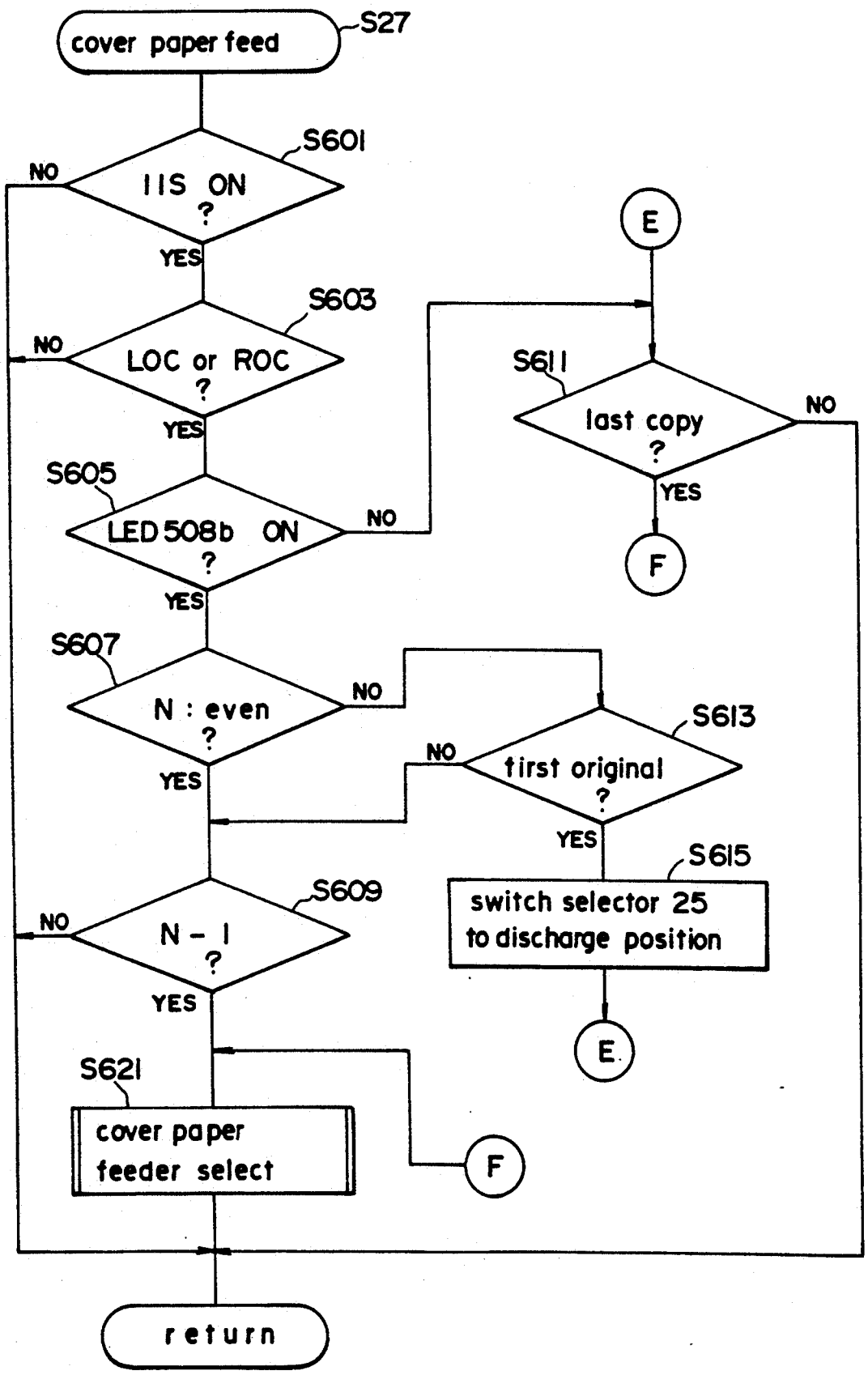
FIG. 12 is a flow chart showing the cover paper feed process routine executed in the main routine.
Figure 13:
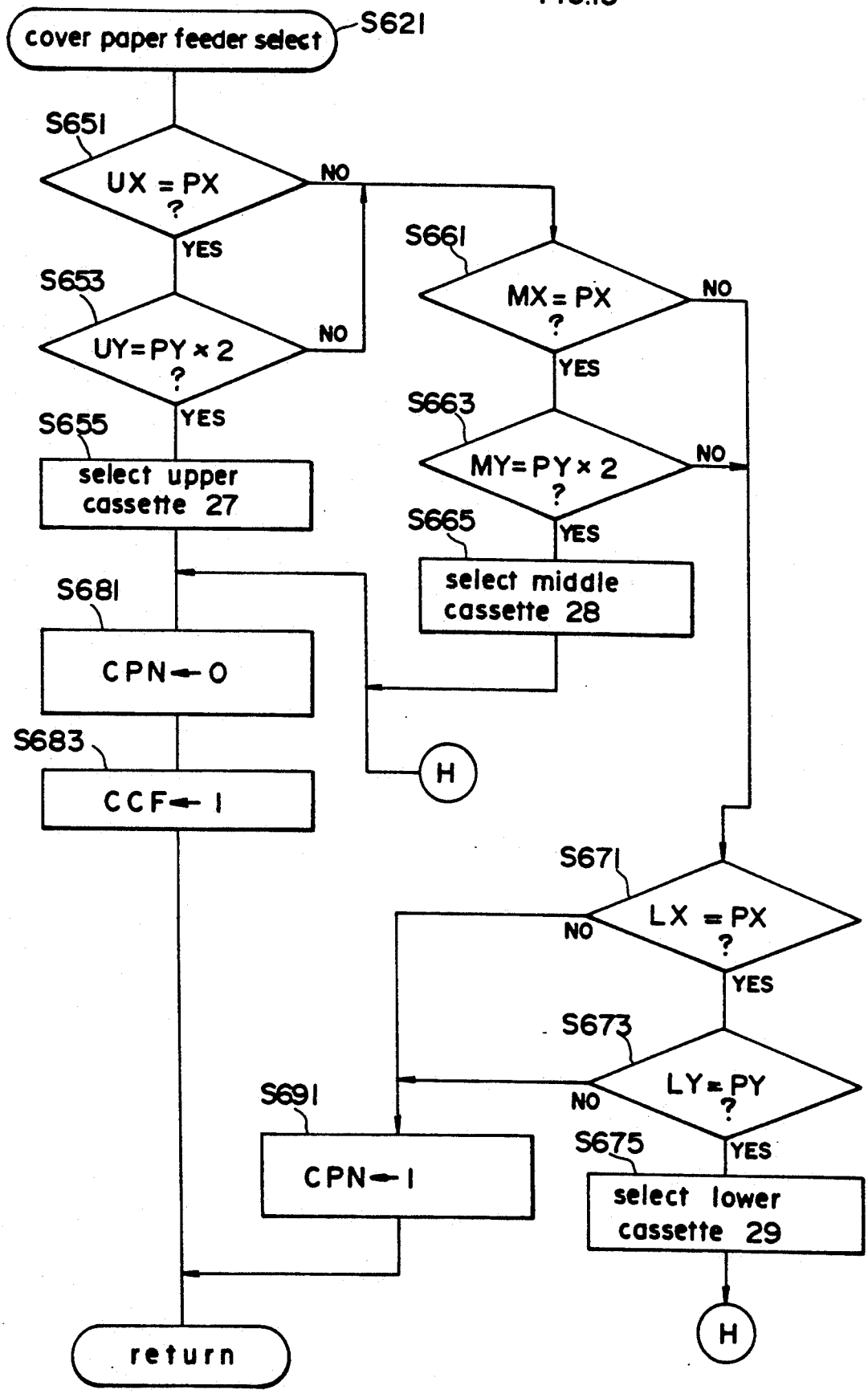
FIG. 13 is a flow chart showing the copy paper feeder select process routine executed in the aforesaid copy paper feed process routine.

(g) Cover Paper Feed Process (FIGS. 12 and 13)

The cover paper feed process (S27) corresponds to the process for forming a copy image on the last copy sheet (cover paper).

That is, when an original is set on the document platen 30 (step S601, YES) and either cover mode (left-cover-open mode LOC or right-cover-open mode ROC) has been set (step S603, YES), the process is executed as described below in accordance with the set copy mode.

Single-Side Original/Duplex Copy Mode (Step S605, YES)

When the total number of originals "N" is an even number of sheets (step S607, YES), the cover paper feeder selection process (S621) is executed. Thus, a cover paper is fed which is twice as large as the normal content page (noncover page) sheets.

When the total number of originals "N" is an odd number of sheets (step S607, NO), then, relative to a first original (step S613, YES), the discharge selector 25 is set at the discharge position (step S615) and duplex copying is terminated. The second and subsequent originals are treated in the same way as when the total number "N" of originals is an even number of sheets. The last single-sheet original (step S609, YES), is handled by executing the cover paper feeder selection process (step S621).

Single-Side Original/Single-Side Copy Mode (Step S605, NO)

This routine is executed only when the last original is to be copied (step S611, YES). The cover paper feeder selection process (S621) is executed.

The cover paper feeder selection process (S621) is a process for feeding a last copy sheet which is twice as large as the content page (noncover page) sheets. This process is executed as shown in FIG. 13.

For example, when the length UX of the paper accommodated in the upper cassette paper 27 is the same as the length PX of the paper (noncover sheets) previously fed (step S651, YES) and the width UY of the paper accommodated in the upper cassette 27 is twice as large as the width PY of the paper (noncover sheets) previously fed (step S653, YES), the upper cassette 27 is selected as the feeder for the last copy sheet (cover sheet) (step S655). Then, the cover paper NO flag CPN is reset at [0] (step S681), and the cover copy flag CCF is set at [1] (step S683).

When the paper accommodated in the upper cassette 27 does not fulfill the aforesaid conditions and the paper in the middle cassette 28 does fulfill said conditions (step S661, YES and step S663, YES), the middle cassette 28 is selected (step S665). Similarly, when the middle cassette 28 does not fulfill the aforesaid conditions and the lower cassette 29 does fulfill said conditions (step S671, YES, step S673, YES), the lower cassette 29 is selected (step S675).

If none of the copy paper accommodated in any cassette fulfills the aforementioned conditions, the cover paper NO flag CPN is set at [1] (step S691).

Figure 14:
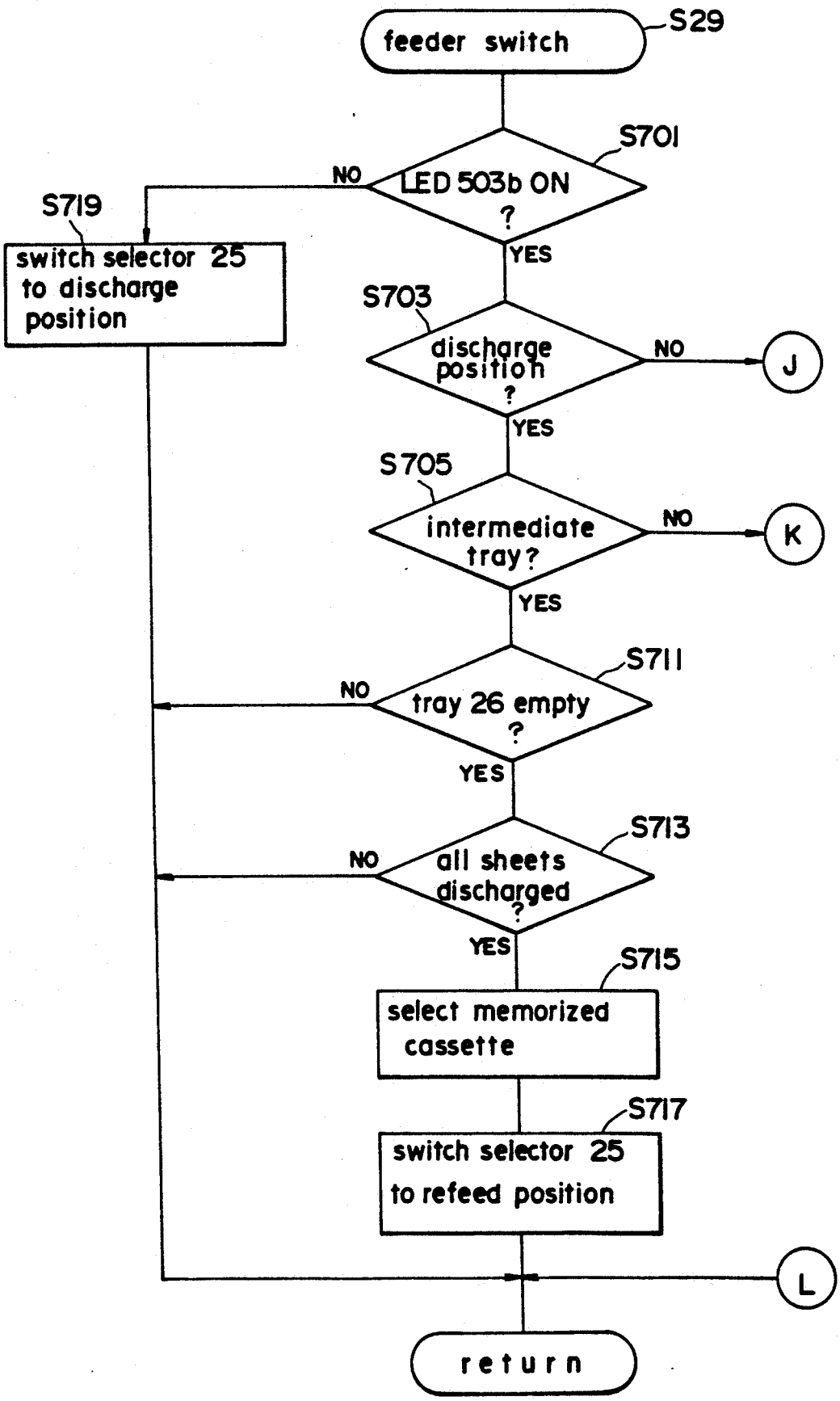
FIG. 14 is a flow chart showing a portion of the paper feeder switch process routine executed in the main routine.
Figure 15:
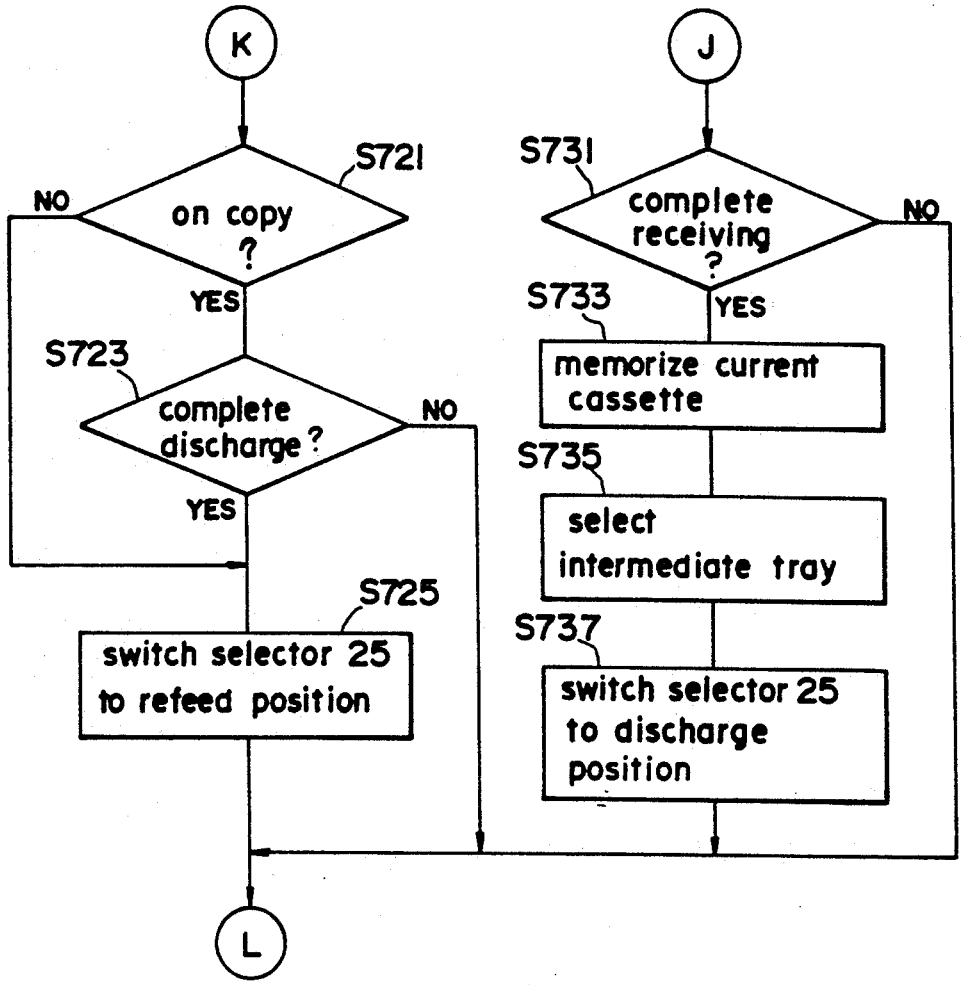
FIG. 15 is a flow chart showing the remaining portion of the paper feeder switch process routine executed in the main routine.

(h) Feeder Switch Process (FIGS. 14 and 15)

In the feeder switch process (step S29), executes controls so as to switch the paper predischarge position (intermediate tray 26 position or finisher 40 position) after the copying process, and switch the feeder origin (cassettes 27, 28 and 29 or intermediate tray 26).

For example, when the duplex copy mode is not set (step S701, NO), the selector 25 is set in the discharge position so as to discharge the copy sheet to the finisher 40 after the copying process without using the intermediate tray 26 (step S719).

On the other hand, when the duplex copy mode is set (step S701, YES), the current position of the selector 25 is checked (step S703). In the initialization state, said selector 25 is set in the discharge position (finisher 40 position).

When the selector 25 is set in the finisher 40 position in step S703 (step S703, YES) and the intermediate tray 26 has not been selected (step S705, NO) and the copy process has not started (step S721, NO), the selector 25 is set at the refeed position to the intermediate tray 26 (step S725). This sets the preparation for the copy process for the first side of the copy sheets. When the copy process has already started in step S721 (step S721, YES), the completed discharge of the number of copy sheets is awaited (step S723, YES), then the selector 25 is set at the refeed position to the intermediate tray 26.

Therefore, when the selector 25 is set in the refeed position to the intermediate tray 26 (step S703, NO), the completion of the specified number of copies (first-side of the sheet is copied) is awaited. When the aforesaid number of copy sheets have been received in the intermediate tray 26 (step S731, YES), the currently selected cassette is stored in memory (step S733), then the feeder origin is changed to the intermediate tray 26 (step S735), and the selector 25 is set in the discharge position (i.e., finisher 40 position) (step S737). Thus, the preparation is completed for the copying process of the second side of the copy sheets.

When the selector 25 is set in the discharge position (i.e., finisher 40 position) (step S703, YES) and the intermediate tray 26 is set as the feeder origin (step S705, YES), the completed reception of all copy sheets in the intermediate tray 26 is awaited. Then, when all copy sheets have been received in the intermediate tray 26 (step S711, YES) and all copy sheets have undergone the copying process for the second side and all have been discharge to the finisher 40 (step S713, YES), the cassette previously stored in memory in step S733 is reset as the feeder origin (step S715), and the selector 26 is set in the refeed position to the intermediate tray 26 (step S717). This resetting completes the preparation for the copying process for first-side copies.

Accordingly, the feeder origin and predischarge position are set in accordance with the copying process for first-side copies or second-side copies.

Figure 16:
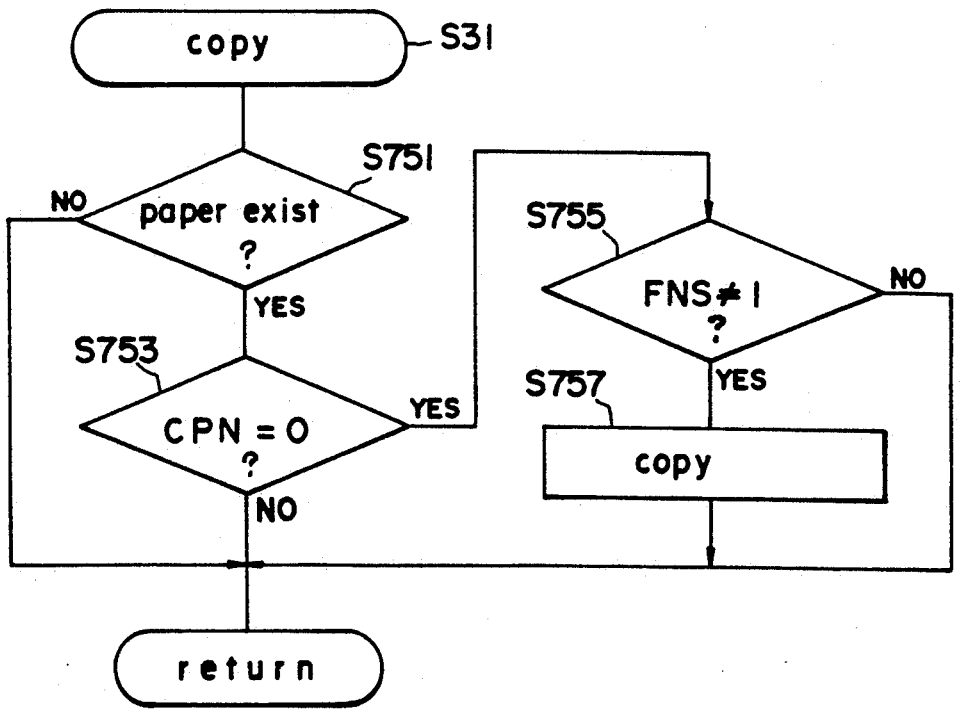
FIG. 16 is a flow chart showing the copy operation process routine executed in the main routine.
Figure 17:
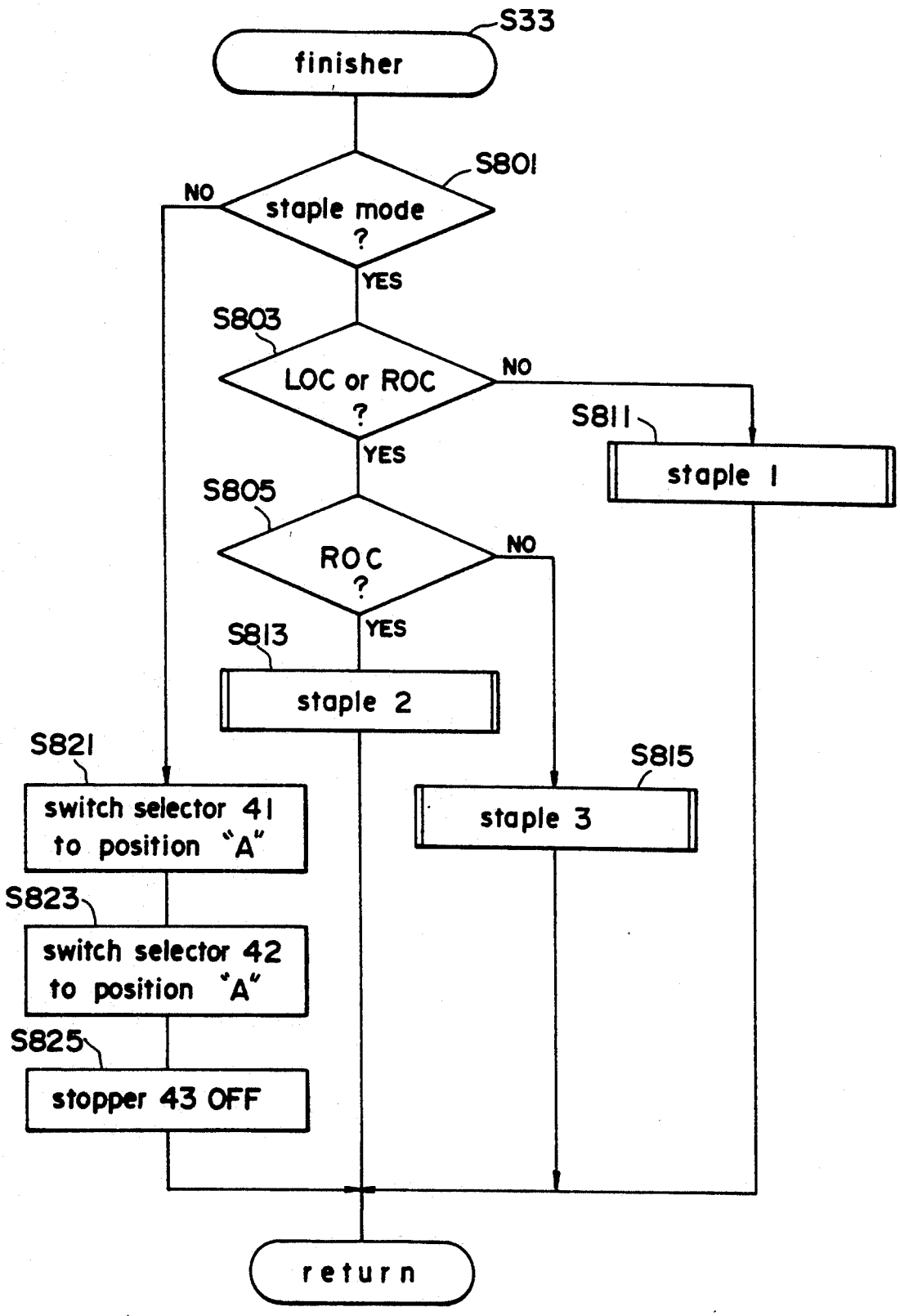
FIG. 17 is a flow chart showing the finishing process routine executed in the main routine.

(i) Copy Operation Process (FIG. 16)

In this process, prior to the execution of the process for the copy operation (step S757), a check is made to determine whether or not copy paper is present and when the aforementioned predetermined conditions are fulfilled, the process of step S757 is executed. That is, when copy paper of the selected size is present (step S751, YES) and the cover paper copy mode is set (step S753, YES) and the finishing flag FNS (described later) is not set at [1], the copy operation is executed (step S757).

(j) Finishing Process (FIGS. 17~23)

In the finishing process (step S33), the operation of the rollers, selectors and stoppers within the finisher are controlled in accordance with set mode and with a predetermined timing. Stapling and the like are accordingly executed.

Figure 26:
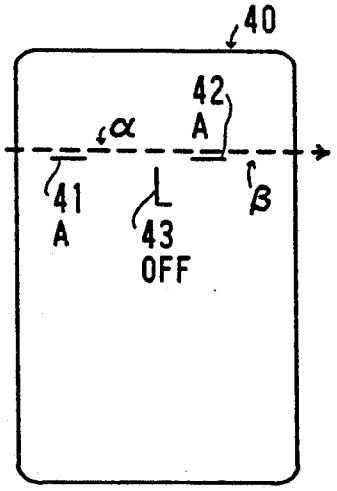
FIG. 26 is an illustration showing the copy paper feed path of the non-staple mode.

For example, when the staple mode is not set (step S801, NO), the selector 41 is set at the A position and selector 42 is set at the A position (steps S821, S823), the stopper 43 is turned OFF and retracted from the feed path $\alpha$, as shown in FIG. 26. Accordingly, the copy paper sequentially fed from the copying apparatus main unit 20 pass through the feed path $\alpha \rightarrow \beta$ of the finisher 40 so as to be discharged into the tray 24.

On the other hand, when the staple mode is set (step S801, YES), the process is executed in accordance with the setting, or lack thereof, of the cover paper mode.

That is, when the cover paper mode is not set (step S803, NO), the staple process 1 is executed (step S811). When the right-cover-open mode ROC is set (step S805, YES), staple process 2 is executed (step S813). When the left-cover-open mode LOC is set (step S805, NO), the staple process 3 is executed (step S815).

Figure 18:
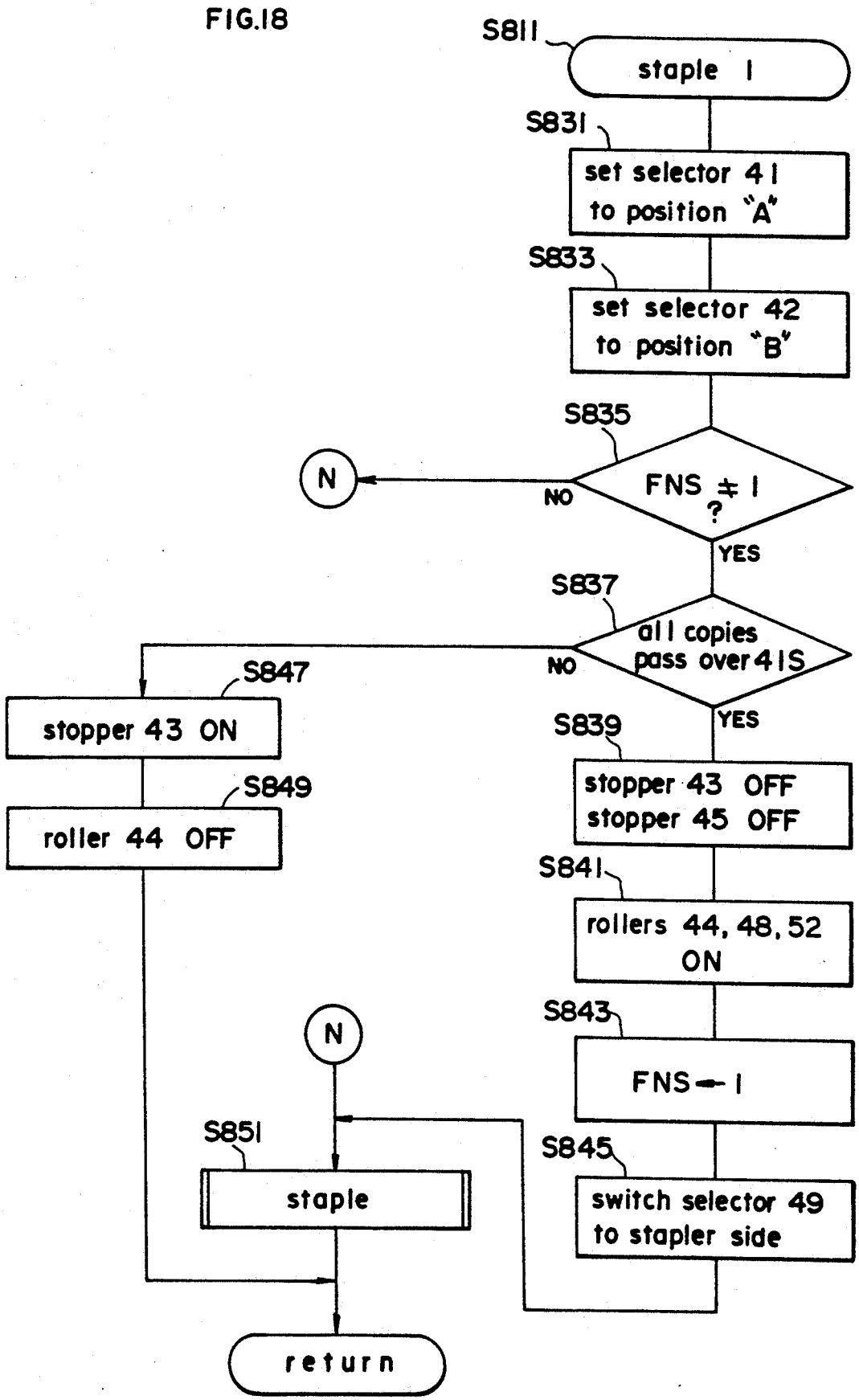
FIG. 18 is a flow chart showing the staple process 1 routine executed in the finishing process routine.

Staple Process 1 (FIG. 18)

Figure 27:
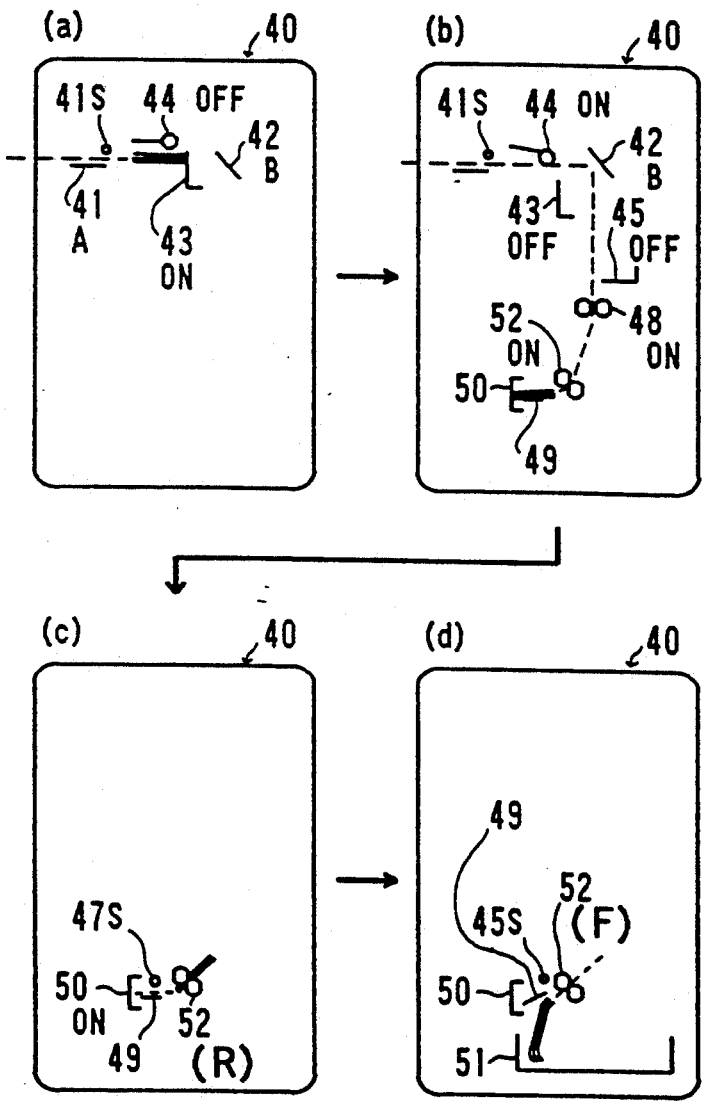
FIGS. 27(*a*)–27(*d*) are illustrations showing the copy paper feed path of the staple mode.

First, the selector 41 is set at the A position and selector 42 is set at the B position (steps S831, S833), as shown in FIG. 27*a*. Since originally the finishing flag FNS is set at [0] (step S835, YES) and all the copy sheets do not pass the sensor 41S position (step S837, NO), the process is executed from step S847 onward. That is, the stopper 43 is switched ON so as to be set in position in the feed path $\alpha$ (step S847) and the roller 44 is turned OFF (step S849). Thus, the leading edge of the copy paper sequentially fed from the copying apparatus main unit 20 contacts the stopper 43 and is stopped thereby.

Then, when all the copy sheets have passed the sensor 41S position (step S837, YES), the stoppers 43 and 45 are turned OFF and retracted from the feed path (step S839), and the rollers 44, 48 and 52 are turned ON (step S841). Then, the finishing flag FNS is set at [1] (step S843), and the selector 49 is set in the stapler 50 position (step S845). Therefore, the stack of copy papers directly in front of the stopper 43 is fed through the feed path $\delta \rightarrow \zeta$ to the stapler 50 position (refer to FIG. 27*a*).

When the stacked copies are set at the stapler 50 position, the stapling operation process (S851) is executed insofar as the finishing flag FNS is set at [1] (step S835, NO).

The stapling operation process (step S851) feeds the bundled copy sheets in the reverse direction into the receiving tray 51 after being stapled (refer to FIG. 27c). Details of this process are described later.

Figure 19:
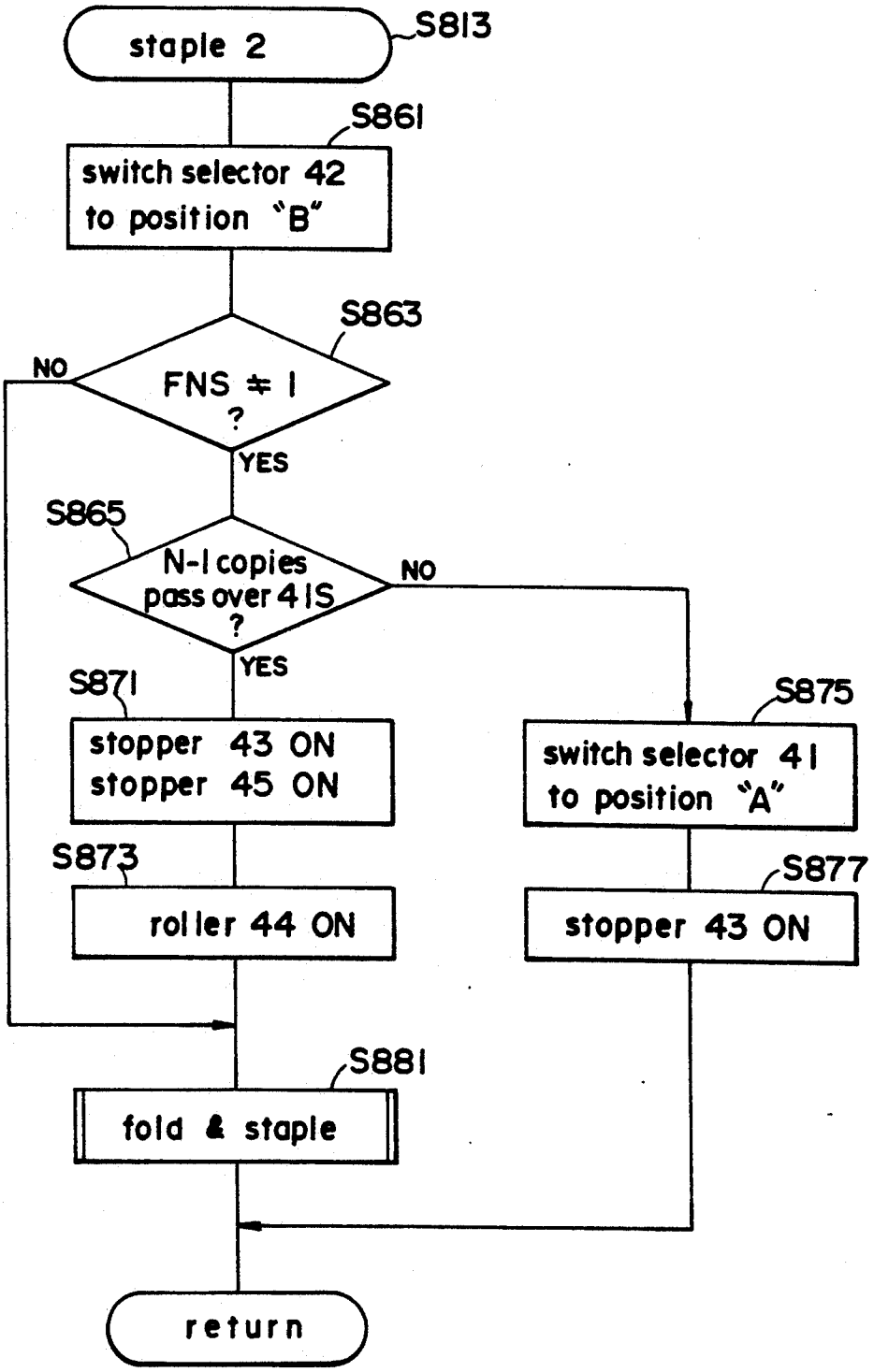
FIG. 19 is a flow chart showing the staple process 2 routine executed in the finishing process routine.

Staple Process 2 (FIG. 19)

Figure 28:
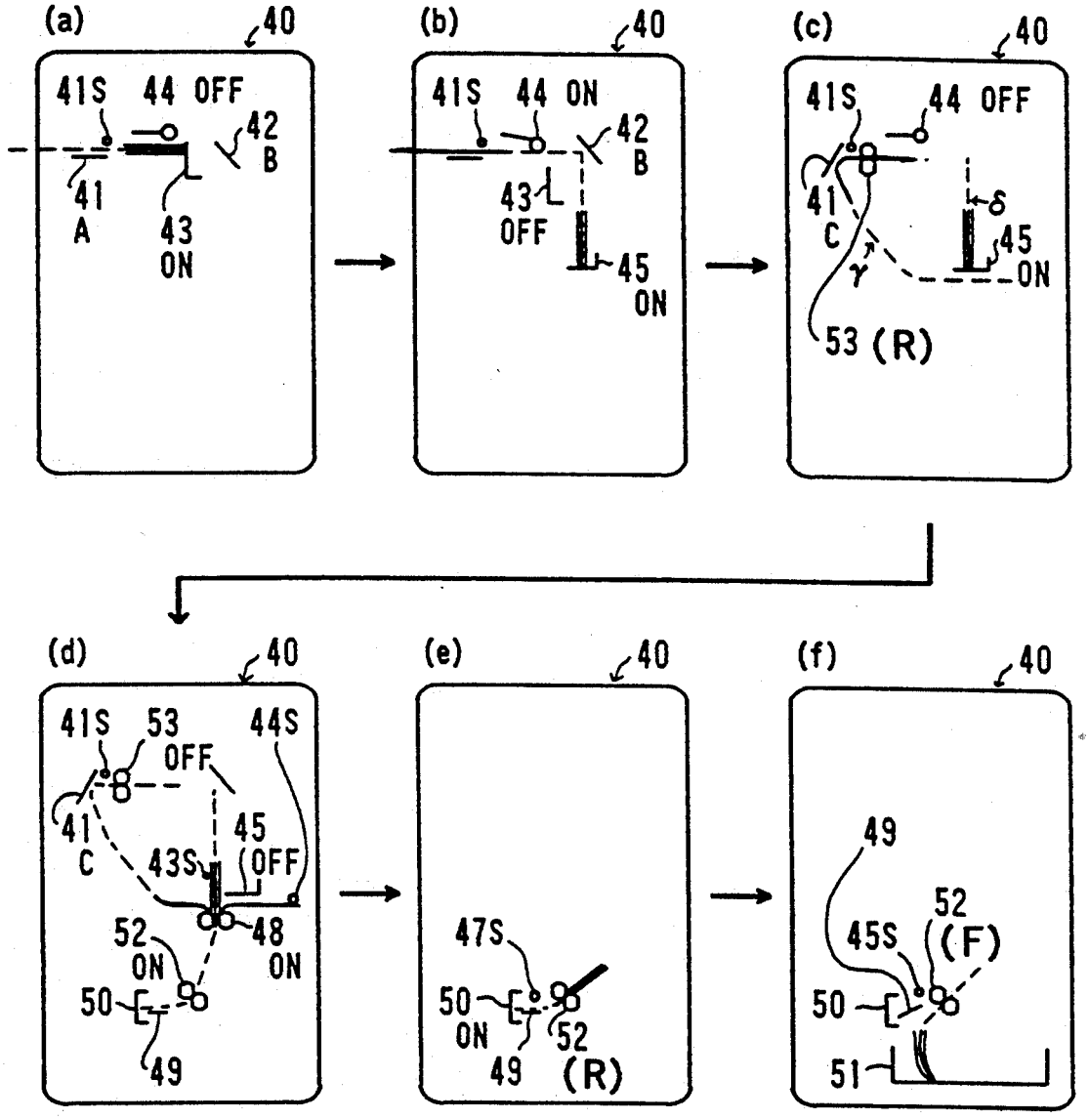
FIGS. 28(*a*)–28(*f*) are illustrations showing the copy paper feed path of the right-cover-open mode.

First, the selector 42 is set at position B (step S861), as shown in FIG. 28a. Initially, the finishing flag FNS is set at [0] (step S863, YES), such that N−1 copy sheets do not pass the sensor 41S position (step S865, NO). Therefore, the process is executed form step S875 onward. That is, the selector 41 is set in the A position (step S875) and the stopper 43 is turned ON so as to be positioned in the feed path α (step S877). Accordingly, the leading edge of the copy papers sequentially fed from the copying apparatus 20 contacts and is stopped by the stopper 43.

Then, when N−1 copy sheets (the number of originals N less 1) pass the sensor 41S position (step S865, YES), the stopper 43 is turned OFF so as to be retracted from the feed path α (step S871), as shown in FIG. 28b. The roller 44 is turned ON to start feeding the sheets (step S873). The bundled copy sheets disposed directly in front of the stopper 43 are therefore fed in the reverse direction through the feed path δ via the selector 42 so as to contact and be stopped by the stopper 45. These bundled copy sheets do not have a cover sheet.

On the other hand, the previously described transport of the copy sheets is started, the fold and staple process is started (step S881) insofar as the finishing flag FNS is set at [1] (step S863, NO).

The fold and staple process (step S881), as shown in FIGS. 28c through 28d, reverses the front and back ends of the cover sheet fed last from the copying apparatus 20 in the feed path α, so as to be fed through the feed path γ such that the center of said copy sheet is stopped in position directly below the feed path δ (at this time the leading edge of the cover sheet is present within the feed path ε). Thereafter, the stopper 45 is retracted from the feed path δ and the cover sheet is folded and the bundle of copy sheets is held therebetween and fed to the stapler 50 position, whereupon the stapling process (step S851) is executed. Details of this process are described later.

Figure 20:
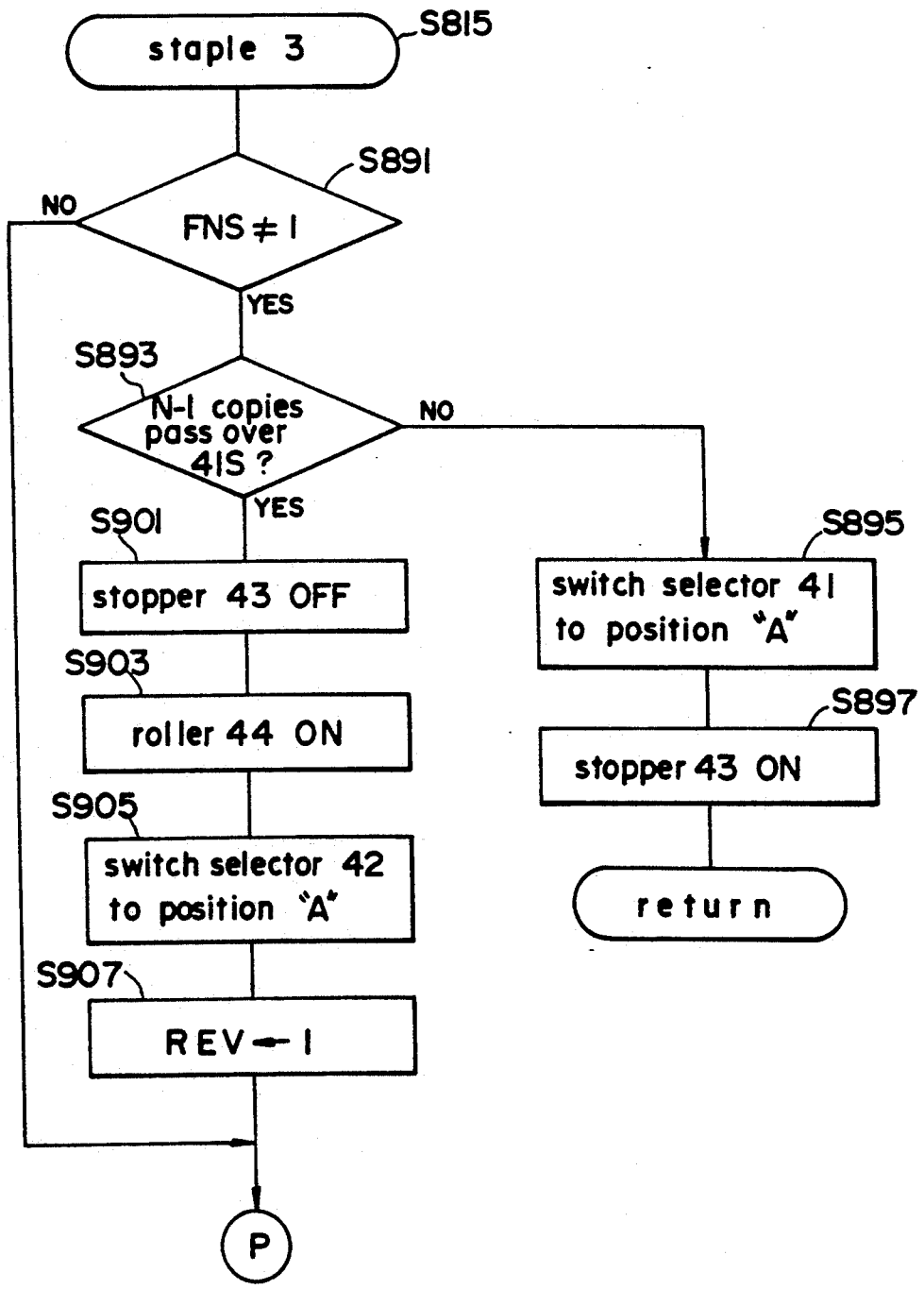
FIG. 20 is a flow chart showing a portion of the staple process 3 routine executed in the finishing process routine.
Figure 21:
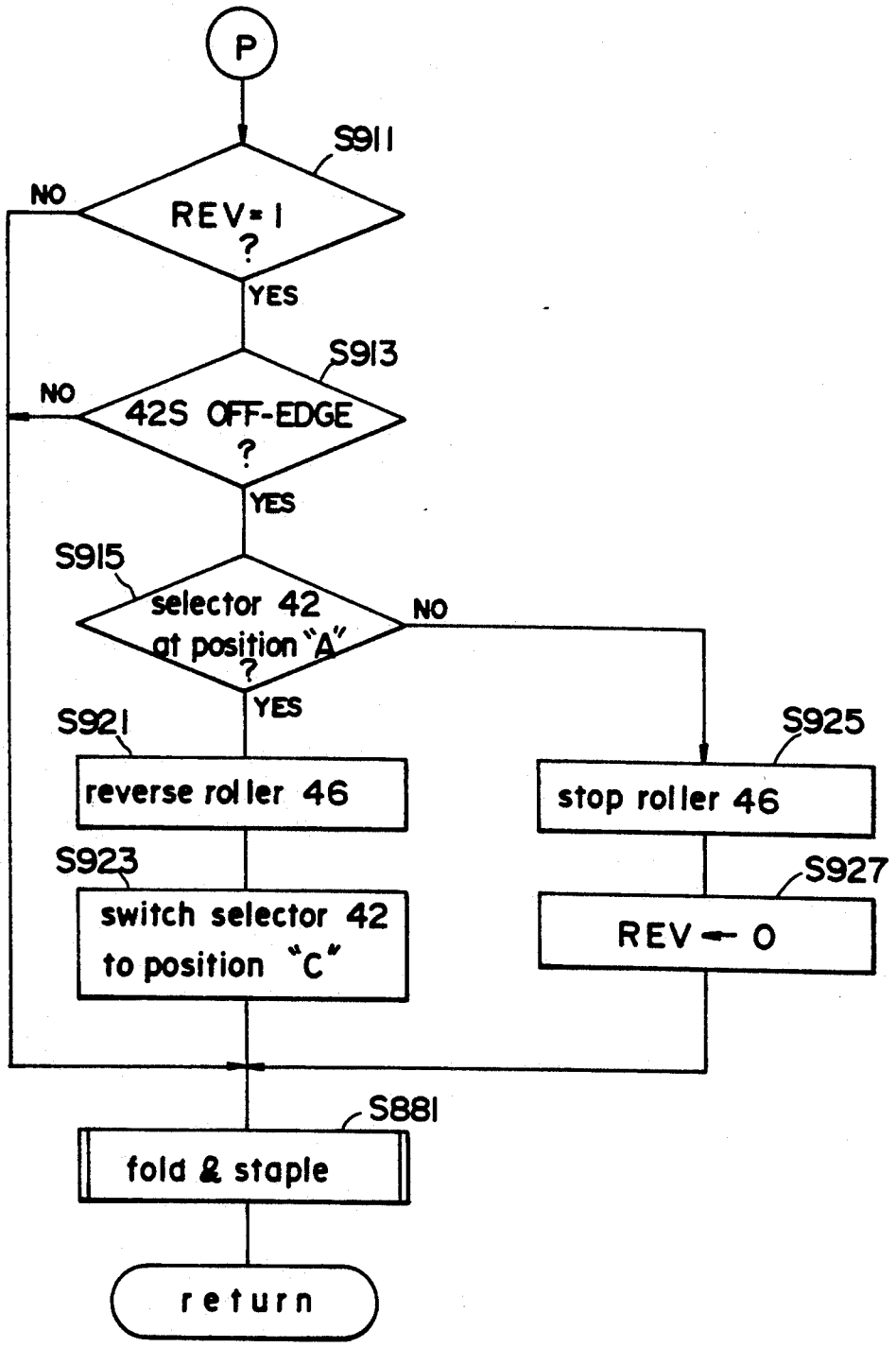
FIG. 21 is a flow chart showing the remaining portion of the staple process 3 routine executed in the finishing process routine.

Stapler Process 3 (FIGS. 20 and 21)

Figure 29:
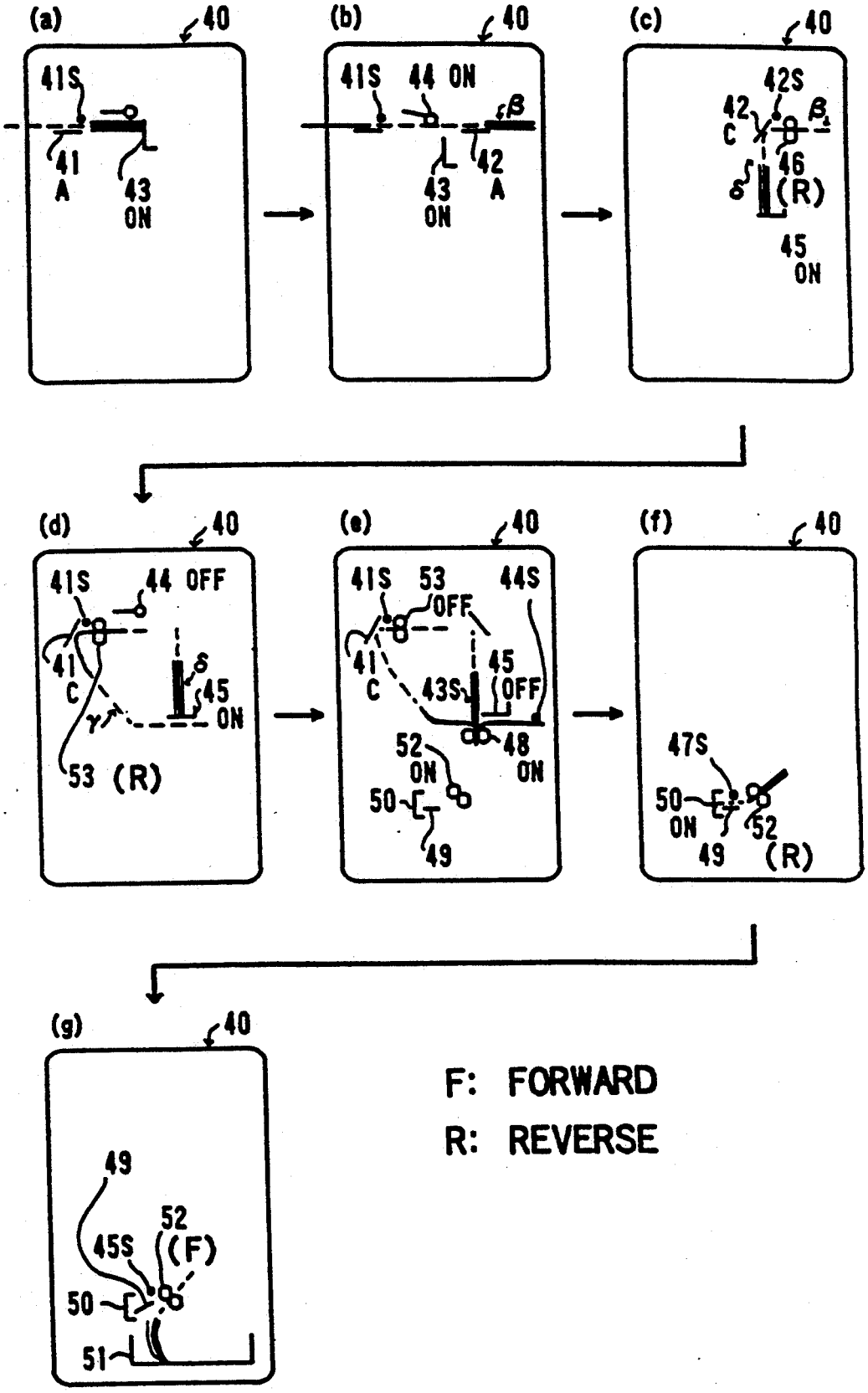
FIGS. 29(*a*)–29(*g*) are illustrations showing the copy paper feed path of the left-cover-open mode.

The finishing flag FNS is initially set at [0] (step S891, YES) and N-1 copy sheets (the number of originals N less 1) do not pass the sensor 41S position (step S893, NO). Therefore, the process is executed from step S895 onward. That is, the selector 41 is set in the A position (step S895), and the stopper 43 is turned ON so as to be position in the feed path α (step S897), as shown in FIG. 29a. Accordingly, the leading edge of the copy papers sequentially fed from the copying apparatus 20 contacts and is stopped by the stopper 43.

Then, when N−1 copy sheets (the number of originals N less 1) pass the sensor 41S position (step S893, YES), the stopper 43 is turned OFF so as to be retracted from the fed path α (step S901). The roller 44 is turned ON so start feeding the sheets (step S903). Next, the selector 42 is switched to the A position (step S905). Therefore, the bundle of copy sheets disposed directly in front of the stopper 43 is fed to the feed path β.

Furthermore, the reverse flag REV is set at [1] (step S907).

Next, the trailing edge of the aforesaid copy sheets pass the sensor 42S at the entrance to the feed path β so that when the OFF-Edge state of said sensor is detected (step S911, YES and step S913, YES). At this time, since the selector is set at the A position (step S915, YES), the process is executed from step S921 onward. That is, the roller 46 is reversely rotated (step S921) and the selector 42 is set at the C position (step S923). Therefore, the front and back edges of the bundle of copy sheets are reversed in feed path β, and the edge of the copy sheets which was originally the trailing edge is guided by said selector 42 so as to be introduced into the feed path δ.

Thereafter, when the initial leading edge of the bundle of copy papers passes the sensor 42S and the OFF-Edge state is again detected (step S911, YES and step S913, YES), this time the selector 42 is set in the C position (step S915, NO) so that the process is executed from step S925 onward. That is, the roller 46 is stopped (step S925) and the reverse flag REV is reset at [0] (step S927).

The reversing of the aforesaid copy sheets (steps S921 and S923) is executed with the previously described fold and staple process (step S881).

Figure 22:
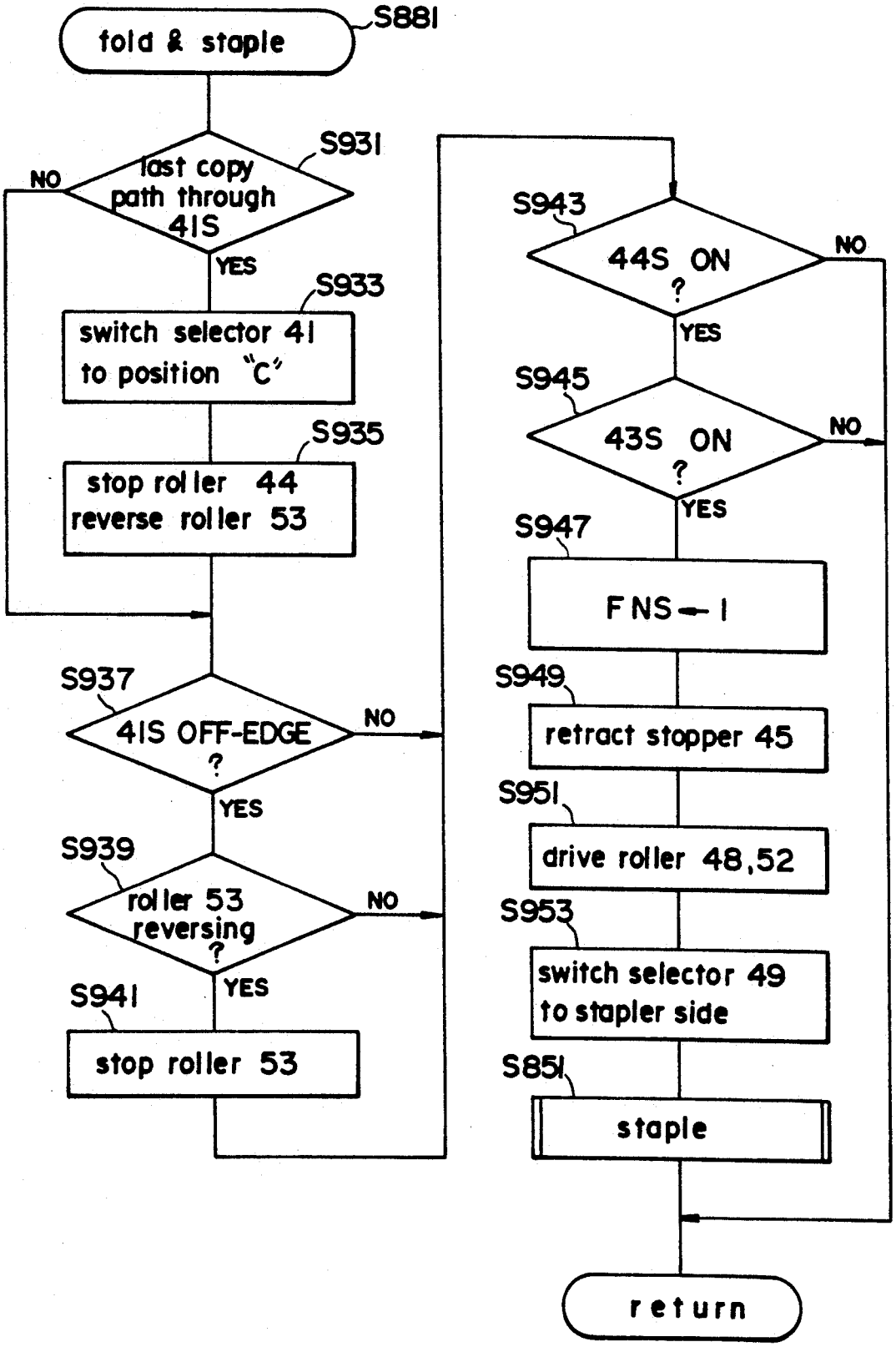
FIG. 22 is a flow chart showing the fold and staple process routine executed in the aforesaid staple process routine 2 and staple process routine 3.

Fold and Staple Process (FIG. 22)

When the trailing edge of the copy paper fed last from the copying apparatus 20 (cover sheet copy paper) passes the sensor 41S position (step S931, YES), the selector 41 is set at the C position (step S933), as shown in FIGS. 28c and 29d. The roller 44 is turned OFF, and the roller 53 is reversely rotated (step S935). Therefore, the front and back ends of the cover sheet copy paper are reversed in the feed path α such that the original trailing edge of the cover sheet is advanced into the feed path γ.

Then, the trailing edge of the aforesaid cover sheet copy paper (originally the leading edge) passes the sensor 41S position and the OF-Edge state is detected (step S937, YES). At this time, the roller 53 is reversely rotating (step S939, YES) such that the process of step S941 is executed, and the roller 53 is stopped.

The leading edge of the aforesaid cover sheet copy paper (originally the trailing edge) is fed through the feed path γ to the feed path ε and the sensor 44S is turned ON (step S943, YES), the sensor 43S is turned ON via the bundle of copy paper (noncover sheet) fed into the feed path δ (step S945, YES), and the finishing flag FNS is set at [1] (step S947). Furthermore, the stopper 45 is turned OFF and retracted from the feed path δ (step S949), as shown in FIGS. 28d and 29e. The rollers 48 and 52 are turned ON (step S951) and the selector 49 is set at the stapler 50 position (step S953). Therefore, the aforesaid cover sheet copy paper is folded and the bundle of copy papers are held therebetween such that both are fed to the stapler 50 position.

The stapling operation process (step S851) is executed under the aforesaid conditions.

Figure 23:
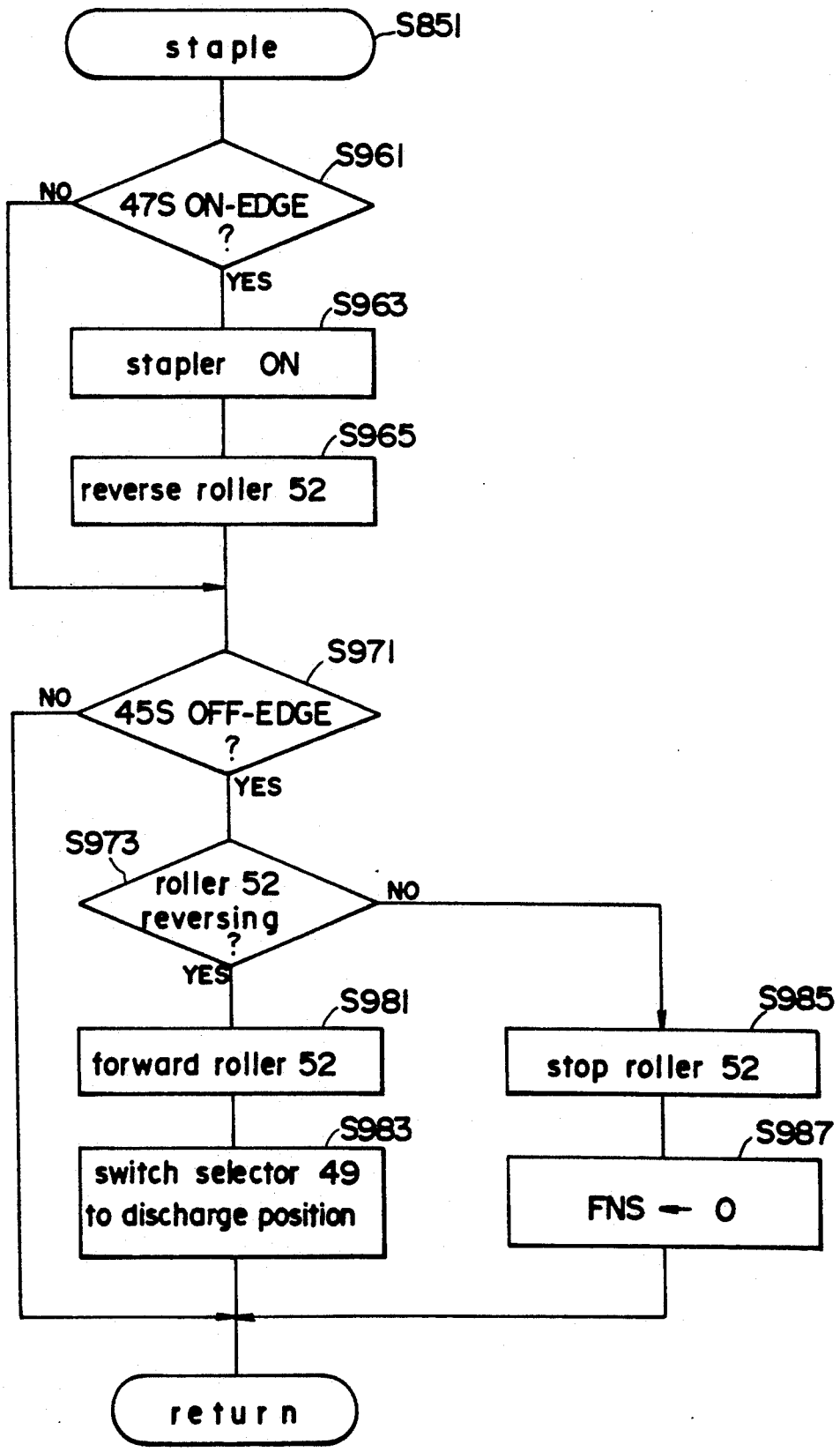
FIG. 23 is a flow chart showing the staple operation process routine executed in the aforesaid staple process 1 routine and the fold and staple process routine.

Stapling Operation Process (FIG. 23)

When the copy paper is detected by the sensor 47S provided directly in front of the stapler 50 (step S961, YES), the stapling operation process is executed (step S963). The roller 52 is reversely rotated (step S965). Therefore, the bundle of copy paper is once retracted to the feed path ζ, as shown in FIGS. 27c, 28e and 29f.

Next, the trailing edge (from the stapler 50 side) of the aforesaid retracting copy paper passes the sensor 45S and the OFF-Edge state of said sensor is detected (step S971, YES). At this time, the roller 52 is reversely rotating (step S973, YES) and the process is executed form step S981 onward. That is, the roller 52 is reversely rotated (step S981) and the selector 49 is set at the discharge position (receiving tray 51 position) (step S983). Accordingly, the copy paper is fed to the receiving tray 51, as shown in FIGS. 27*d* and 28*f*.

When the sensor 45S ON-Edge state is detected (step S971, YES), the roller 52 is forwardly rotating (step S973, NO). Therefore, the process is executed from step S985 onward, i.e., the roller 52 is stopped (step S985) and the finishing flag FNS is reset at [0] (step S987).

As previously described, the present copying apparatus is controlled so as to realize the non-staple mode paper feeding process, noncover mode stapling process, right-cover-open mode stapling process, and left-cover-open mode stapling process in the finisher 40.

The aforesaid copying apparatus discriminates between content page originals and cover page originals, feeds a cover page original copy paper that is larger than the content page original copy paper, folds the cover page original copy paper in two after the copying process and holds the content page original copy paper between said folded cover page, and staples the copies on the aforesaid fold.

The aforesaid copying apparatus can automatically fold a copy paper comprising an area for image formation of the cover page original and a blank area contiguous therewith, hold copies of the content page originals between said folded cover page copy paper such that said content page copies are arranged in ascending order from the aforesaid area for image formation of the cover page original to the blank area contiguous therewith, and thereafter staple the copy sheets on the aforesaid fold.

The bound copies have clean lines because the front cover sheet and the back cover sheet are integratedly continuous.

Furthermore, right-cover-open bound copies and left-cover-open bound copies can be freely set.

Still further, in the duplex copy mode, the image corresponding to the first page of the content page originals can be formed on the back side (interior side) of the cover paper.

In the aforesaid embodiment, the original fed last by the RDH 10 is discriminated as the cover page original, and a large size copy paper is fed as the cover sheet. However, the present invention is not limited to the aforesaid arrangement inasmuch as, for example, the original fed first by the RDH 10 may be discriminated as the cover page original, and a large size copy paper is fed as the cover sheet.

In the present embodiment, the cover page original and the content page originals are set in the RDH 10, and a large size copy paper is fed for the cover page original and smaller size copy paper is fed for the content page originals. However, the present invention is not limited to the aforesaid arrangement inasmuch as, for example, only the content page originals may be set in the RDH 10 and copied onto small size copy paper which is then accommodated in the finisher 40, and after the copy process of the content page originals is completed, a larger size copy paper may be fed to the finisher 40 without copying thereon so as to be bound together with the small size copy paper previously accommodated in said finisher 40. That is, the cover page may be left blank.

Although in the aforesaid embodiment small size copy paper used for copying the content page originals were held between a larger size copy paper used as the cover page and those small size copy papers and large size copy paper are stapled together, the present invention is not limited to such an arrangement. For example, after the small size copy paper for the content page originals are held between the larger size copy paper of the cover page, the bundle of copy papers may be accommodated in the receiving tray 51 without being stapled.

In the aforesaid embodiment, a copying apparatus for copying original documents set in the RDH 10 was given as an example of the image forming apparatus. However, the present invention is not limited to the aforesaid copying apparatus inasmuch as the invention may be applied to, for example, laser printers which record electrical original document image signals on a recording sheet, and LED printers. For example, in a laser printer, images can be formed on small size recording paper for a single set of original document data, said recording paper can be accommodated in the finisher 40, and thereafter a larger size recording paper can be fed to the finisher 40.

In the aforesaid embodiment, the cover paper feeder selection process (step S621) is executed after the content page copies are completed, as shown in FIG. 12. In the aforesaid process, when a copy paper suitable for the cover sheet is not loaded in the copying apparatus, the copy paper NO flag CPN is set (step S691) and the cover sheet copy is prohibited. The present invention is not limited to the aforesaid arrangement, however, insofar as, for example, the copy operation may be prohibited at the point of making the cover paper mode selection. That is, the start of the copying operation may be prohibited when the cover paper mode is selected and two kinds of copy paper usable for cover paper mode copies are not loaded in the copying apparatus. Furthermore, the cover paper mode selection may be prohibited when two kinds of copy paper usable for cover paper mode copies are not loaded in the copying apparatus.

What is claimed is:

1. An image forming apparatus comprising:

original feeding device which stacks a plurality of original documents and feeds them one by one to an exposure platen, said original documents including one cover page original and a plurality of content page originals;

image forming device which forms an image of the original fed to said exposure platen on a copy paper;

first paper feeder which feeds a first size copy paper to said image forming device;

second paper feeder which feeds a second size copy paper to said image forming device, said second size being smaller than said first size;

paper feed control device which operates said first paper feeder when said image forming device forms an image of said cover page original and operates said second paper feeder when said image forming device forms images of said content page originals; and mode selector means which selects one of either a first cover mode or a second cover mode, wherein said original feeding device changes the set position of the original document on said exposure platen in accordance with the selected cover mode.

2. An image forming apparatus comprising:

original feeding device which stacks a plurality of original documents and feeds them one by one to an exposure platen, said original documents including one cover page original and a plurality of content page originals;

image forming device which forms an image of the original fed to said exposure platen on a copy paper;

first paper feeder which feeds a first size copy paper to said image forming device;

second paper feeder which feeds a second size paper to said image forming device, said second size being smaller than said first size;

paper feed control device which operates said first paper feeder when said cover page original is fed by said original feeding device and operates said second paper feeder when said content page originals are fed by said original feeding device; and folding device which folds the first size copy paper discharged from said image forming device into two while holding the second size copy paper discharged from said image forming device between the folded first size copy paper.

3. An image forming apparatus as claimed in claim 2, further comprising:

binding device which binds together the folded first size copy paper and the second size copy paper held therebetween.

4. An image forming apparatus as claimed in claim 2, wherein said first copy paper size is twice as large as said second size copy paper.

5. An image forming apparatus comprising:

original feeding device which stacks a plurality of original documents and feeds them one by one to an exposure platen, said original documents including one cover page original and a plurality of content page originals;

image forming device which forms an image of the original fed to said exposure platen on a copy paper;

first paper feeder which feeds a first size copy paper to said image forming device;

second paper feeder which feeds a second size copy paper to said image forming device, said second size being smaller than said first size;

paper feed control device which operates said first paper feeder when said image forming device forms an image of said cover page original and operates said second paper feeder when said image forming device forms images of said content page originals; and wherein said image forming device has a duplex copying function and forms an image of the cover page original at a first area on one side of a first size copy paper and also forms an image of one of the content page originals at a second area on a second side of the same first size cover paper.

6. An image forming apparatus as claimed in claim 5, wherein said first area is located at a rear position of said second area.

7. An image forming apparatus comprising:

original feeding device which stacks a plurality of original documents and feeds them one by one to an exposure platen, said original documents including one cover page original and a plurality of content page originals;

image forming device which forms an image of an original fed to said exposure platen on a copy paper;

plurality of paper feeders each of which contains different size copy paper and feeds copy paper to said image forming device;

paper size detector which detects the sizes of copy paper contained in said paper feeders; and paper feed control device which operates any one of said paper feeders which contains a first size copy paper when said cover page original is fed by said original feeding device and operates any one of said other paper feeders which contains a second size copy paper when said content page originals are fed by said original feeding device.

8. An image forming apparatus as claimed in claim 7, further comprising:

folding device which folds the first size copy paper discharged from the image forming device into two while holding the second size copy paper discharged from the image forming device between the folded first size copy paper.

9. An image forming apparatus as claimed in claim 8, further comprising:

binding device which binds together the folded first size copy paper and the second size copy paper held therebetween.

10. An image forming apparatus as claimed in claim 7, wherein said first size copy paper is twice as large as said second size copy paper.

11. An image forming apparatus which forms a set of original copies in one job cycle, comprising:

image forming device which forms original images on copy paper;

first feeder which feeds one sheet of a first size copy paper to a discharge position by way of said image forming device during a single job cycle;

second feeder which feeds a plurality of sheets of a second size copy paper to a discharge position by way of said image forming device during the single job cycle;

folding device, provided at the discharge position, which receives said first size copy paper and said plurality of second size copy paper and folds the first size copy paper into two while holding the second size copy paper between the folded first size copy paper.

12. An image forming apparatus as claimed in claim 11, further comprising:

binding device which binds together the folded first size copy paper and the second size copy paper held therebetween.

13. An image forming apparatus as claimed in claim 11 wherein said first size copy paper is twice as large as said second size copy paper.

* * * * *

UNITED STATES PATENT AND TRADEMARK OFFICE

CERTIFICATE OF CORRECTION

PATENT NO. : 5,257,081

DATED : October 26, 1993

INVENTOR(S) : Tomokazu KATO et al

It is certified that error appears in the above-indentified patent and that said Letters Patent is hereby corrected as shown below:

Title page, item [54], delete "DRIVE" and insert -- DEVICE --.

Signed and Sealed this

Fifth Day of April, 1994

Bruce Lehman

*Attest:*

BRUCE LEHMAN

*Attesting Officer*

*Commissioner of Patents and Trademarks*